US010388102B2

(12) United States Patent
Wilson et al.

(10) Patent No.: US 10,388,102 B2
(45) Date of Patent: Aug. 20, 2019

(54) UNIT DOSE DISPENSING SYSTEMS AND METHODS

(71) Applicant: Omnicell, Inc., Mountain View, CA (US)

(72) Inventors: Edith Wilson, Healdsburg, CA (US); Gerardo Moreno, Pleasanton, CA (US); Guillermo Trejo, Gilroy, CA (US); Vikram Mehta, Pleasanton, CA (US); Herbert Lawson Fisher, Portola Valley, CA (US)

(73) Assignee: Omnicell, Inc., Mountain View, CA (US)

( * ) Notice: Subject to any disclaimer, the term of this patent is extended or adjusted under 35 U.S.C. 154(b) by 0 days.

(21) Appl. No.: 16/232,739

(22) Filed: Dec. 26, 2018

(65) Prior Publication Data

US 2019/0130692 A1 May 2, 2019

Related U.S. Application Data

(62) Division of application No. 15/726,707, filed on Oct. 6, 2017, now Pat. No. 10,262,490, which is a division (Continued)

(51) Int. Cl.
*G07F 11/06* (2006.01)
*G07F 17/00* (2006.01)

(Continued)

(52) U.S. Cl.
CPC ..... *G07F 11/06* (2013.01); *G07F 11/00* (2013.01); *G07F 11/04* (2013.01); *G07F 11/52* (2013.01);

(Continued)

(58) Field of Classification Search
None
See application file for complete search history.

(56) References Cited

U.S. PATENT DOCUMENTS 2,665,184 A 1/1954 Hord
3,194,432 A 7/1965 Breitenstein et al.

(Continued)

FOREIGN PATENT DOCUMENTS

EP 0429660 6/1991
JP 2014204744 10/2014
WO 2014145413 9/2014

OTHER PUBLICATIONS

US 10,137,058 B1, 11/2018, Wilson et al. (withdrawn)

(Continued)

*Primary Examiner* — Gene O Crawford
*Assistant Examiner* — Ayodeji T Ojofeitimi
(74) *Attorney, Agent, or Firm* — Kilpatrick Townsend & Stockton LLP

(57) ABSTRACT

Mechanisms for dispensing items such as medications and medical supplies. Different mechanisms may be tailored to dispensing different kinds of items, for example medications in single dose packages, vials, syringes, or other similarly-shaped items. The dispensers may be placed in a dispensing unit that includes a lockable restock drawer and a dispense drawer into which items are dispensed by the dispensing mechanisms. The various kinds of dispensing mechanisms may be installed in the restock drawer in any workable proportion and arrangement. The dispensing mechanisms include multiple sensing technologies for tracking and inventory of items and for accurate sensing of items as they are dispensed.

20 Claims, 21 Drawing Sheets

Related U.S. Application Data of application No. 14/634,063, filed on Feb. 27, 2015, now Pat. No. 9,818,251.

(51) Int. Cl.

| | |
|---|---|
| ***G07F 11/52*** | (2006.01) |
| ***G07F 11/04*** | (2006.01) |
| ***G07F 11/00*** | (2006.01) |
| ***G07F 11/58*** | (2006.01) |
| ***G07F 11/62*** | (2006.01) |

(52) U.S. Cl.

CPC ..... *G07F 11/58* (2013.01); *G07F 11/62* (2013.01); *G07F 17/0092* (2013.01)

(56) References Cited

U.S. PATENT DOCUMENTS 3,258,109 A 6/1966 Breitenstein et al.
3,258,153 A 6/1966 Morgan et al.
3,369,697 A 2/1968 Glucksman et al.
3,410,452 A 11/1968 Igel et al.
3,443,509 A * 5/1969 Sandy ..... A47F 3/001 219/679
3,677,437 A 7/1972 Haigler
3,921,805 A 11/1975 Compere
3,921,806 A 11/1975 Wawracz
4,266,563 A 5/1981 Fujita
4,310,103 A 1/1982 Reilly, Jr. et al.
4,567,997 A 2/1986 Portyansky
4,573,606 A 3/1986 Lewis et al.
4,597,091 A 6/1986 Blake
4,597,864 A 7/1986 Wiesemann
4,778,042 A 10/1988 Warren et al.
4,872,591 A 10/1989 Konopka
4,980,292 A 12/1990 Elbert et al.
5,148,944 A 9/1992 Kaufman et al.
5,176,285 A 1/1993 Shaw
5,190,185 A 3/1993 Blechl
5,197,632 A 3/1993 Kaufman et al.
5,318,200 A 6/1994 Allen et al.
5,329,459 A 7/1994 Kaufman et al.
5,351,857 A 10/1994 Gonzalez
5,377,864 A 1/1995 Blechl et al.
5,671,262 A 9/1997 Boyer et al.
5,745,366 A 4/1998 Higham et al.
5,755,357 A 5/1998 Orkin et al.
5,805,455 A 9/1998 Lipps
5,805,456 A 9/1998 Higham et al.
5,905,653 A 5/1999 Higham et al.
5,927,540 A 7/1999 Godlewski
6,004,020 A 12/1999 Bartur
6,011,999 A 1/2000 Holmes
6,039,467 A 3/2000 Holmes
6,073,799 A 6/2000 Yuyama et al.
6,151,536 A 11/2000 Arnold et al.
6,170,929 B1 1/2001 Wilson et al.
6,227,407 B1 5/2001 Simeri et al.
6,272,394 B1 8/2001 Lipps
6,286,710 B1 * 9/2001 Paek ..... G07F 5/18 221/124
6,385,505 B1 5/2002 Lipps
6,510,962 B1 1/2003 Lim
6,581,797 B2 6/2003 McKinney, Jr. et al.
6,609,047 B1 8/2003 Lipps
6,625,952 B1 * 9/2003 Chudy ..... B65B 5/103 221/129
6,640,159 B2 10/2003 Holmes et al.
6,640,994 B2 11/2003 Chen
6,760,643 B2 7/2004 Lipps
6,975,922 B2 * 12/2005 Duncan ..... G07F 11/60 700/242
7,006,894 B2 2/2006 de la Huerga
7,348,884 B2 3/2008 Higham
7,359,765 B2 4/2008 Varvarelis et al.
7,383,965 B2 6/2008 Matsumoto
7,395,946 B2 7/2008 Yuyama et al.
7,454,880 B1 * 11/2008 Austin ..... G06F 19/3462 53/411
7,571,024 B2 8/2009 Duncan et al.
7,675,421 B2 3/2010 Higham
7,819,281 B2 10/2010 Guindulain Busto
7,835,819 B2 11/2010 Duncan et al.
7,978,564 B2 7/2011 De La Huerga
8,027,749 B2 9/2011 Vahlberg et al.
8,073,563 B2 12/2011 Vahlberg et al.
8,126,590 B2 2/2012 Vahlberg et al.
8,131,397 B2 3/2012 Vahlberg et al.
8,140,186 B2 3/2012 Vahlberg et al.
8,155,786 B2 4/2012 Vahlberg et al.
8,280,549 B2 10/2012 Liff et al.
8,453,874 B2 6/2013 Simpson et al.
8,744,621 B2 6/2014 Michael
8,851,265 B2 10/2014 Morishita et al.
8,924,227 B2 12/2014 Fellows et al.
8,936,175 B1 1/2015 Song
8,944,281 B2 2/2015 Inoue et al.
9,113,729 B2 8/2015 Righetti et al.
9,149,405 B2 10/2015 Braun
9,492,357 B2 11/2016 MacVittie et al.
9,540,177 B1 1/2017 Yasinski
9,682,016 B1 6/2017 Balasubramanian et al.
9,818,251 B2 11/2017 Wilson et al.
2004/0225409 A1 11/2004 Duncan et al.
2004/0251266 A1 * 12/2004 Yuyama ..... B65G 59/062 221/251
2006/0273106 A1 12/2006 Kim
2007/0150092 A1 * 6/2007 Ohmura ..... G06F 19/3462 700/231
2007/0169437 A1 * 7/2007 Yuyama ..... B65B 43/44 53/467
2008/0319577 A1 12/2008 Vahlberg et al.
2008/0319579 A1 12/2008 Vahlberg et al.
2008/0319789 A1 12/2008 Vahlberg et al.
2008/0319790 A1 12/2008 Vahlberg et al.
2010/0042437 A1 2/2010 Levy et al.
2010/0228392 A1 9/2010 Braun
2012/0029692 A1 2/2012 Owen
2012/0123587 A1 5/2012 Mockus et al.
2012/0248947 A1 10/2012 Kijowski et al.
2012/0259456 A1 * 10/2012 Saltsov ..... A61J 7/0076 700/236
2012/0312853 A1 * 12/2012 Osborne ..... A47K 10/36 225/10
2013/0204432 A1 8/2013 Panetta et al.
2013/0331983 A1 * 12/2013 Barrett ..... G06F 19/3462 700/236
2014/0138398 A1 5/2014 Daniels et al.
2014/0158705 A1 6/2014 Wid
2014/0165887 A1 6/2014 Bane et al.
2014/0288698 A1 9/2014 Handfield et al.

OTHER PUBLICATIONS

U.S. Appl. No. 14/634,063, Final Office Action dated Mar. 31, 2017, 10 pages.
U.S. Appl. No. 14/634,063, Final Office Action dated Jul. 29, 2016, 8 pages.
U.S. Appl. No. 14/634,063, Non-Final Office Action dated Jan. 6, 2016, 11 pages.
U.S. Appl. No. 14/634,063, Non-Final Office Action dated Nov. 25, 2016, 11 pages.
U.S. Appl. No. 14/634,063, Notice of Allowance dated Jul. 13, 2017, 7 pages.
U.S. Appl. No. 15/693,276, Final Office Action dated Feb. 25, 2019, 19 pages.
U.S. Appl. No. 15/693,276, Non-Final Office Action dated Jun. 5, 2018, 12 pages.
U.S. Appl. No. 15/693,276, Restriction Requirement dated Jan. 19, 2018, 6 pages.
U.S. Appl. No. 15/726,707, Non-Final Office Action dated May 30, 2018, 10 pages.

(56) References Cited

OTHER PUBLICATIONS

U.S. Appl. No. 15/726,707, Notice of Allowance dated Feb. 7, 2019, 7 pages.
U.S. Appl. No. 15/726,707, Notice of Allowance dated Sep. 27, 2018, 7 pages.
U.S. Appl. No. 15/726,707, Restriction Requirement dated Jan. 19, 2018, 5 pages.
U.S. Appl. No. 15/729,339, Non-Final Office Action dated Mar. 22, 2018, 11 pages.
U.S. Appl. No. 15/729,339, Notice of Allowance dated Jan. 25, 2019, 7 pages.
U.S. Appl. No. 15/729,339, Notice of Allowance dated Jul. 25, 2018, 7 pages.
U.S. Appl. No. 15/729,353, Final Office Action dated Nov. 29, 2018, 13 pages.
U.S. Appl. No. 15/729,353, Non-Final Office Action dated May 3, 2018, 17 pages.
U.S. Appl. No. 15/729,355, Final Office Action dated Nov. 1, 2018, 9 pages.
U.S. Appl. No. 15/729,355, Non-Final Office Action dated May 3, 2018, 15 pages.
European Patent Application No. 16756164.6, Extended European Search Report dated Dec. 5, 2018, 16 pages.
European Patent Application No. 16756164.6, Partial Supplementary European Search Report dated Aug. 28, 2018, 16 pages.
International Application No. PCT/US2016/019082, International Preliminary Report on Patentability dated Sep. 8, 2017, 9 pages.
International Application No. PCT/US2016/019082, International Search Report and Written Opinion dated Jul. 26, 2016, 13 pages.
International Application No. PCT/US2016/019082, Invitation to Pay Additional Fees and, Where Applicable, Protest Fee dated Apr. 18, 2016, 2 pages.
International Application No. PCT/US2018/045124, International Search Report and Written Opinion dated Aug. 30, 2018, 16 pages.

* cited by examiner

UNIT DOSE DISPENSING SYSTEMS AND METHODS

CROSS REFERENCE TO RELATED APPLICATIONS

This application is a division of U.S. patent application Ser. No. 15/726,707, filed Oct. 6, 2017 and titled "Unit Dose Dispensing Systems and Methods", which is a division of U.S. patent application Ser. No. 14/634,063, filed Feb. 27, 2015 and titled "Unit Dose Dispensing Systems and Methods", the entire disclosures of which are hereby incorporated by reference herein for all purposes.

BACKGROUND OF THE INVENTION

Many industries rely on the accurate inventory and dispensing of secure items. For example, in a hospital setting, it is of paramount importance that patients be given the correct medications in the correct doses. In addition, it is legally required that controlled substances be secured and accurately tracked, and it is also important that inventories of medications and supplies be tracked so that proper business controls can be implemented.

Various dispensing cabinets and carts have been developed to assist in the management of medications and other items. However, improvements are still desired in the reliability of dispensing and tracking of items, and it is also desirable to reduce the amount of space required for item storage and dispensing.

BRIEF SUMMARY OF THE INVENTION

According to one aspect, a dispensing mechanism comprises a connector for receiving electrical signals from a cabinet in which the dispensing mechanism is installed, an actuator that operates in response to the electrical signals, a belt driven by the actuator, and a plurality of spaced-apart paddles for receiving between the paddles items to be dispensed. The paddles are moved by the belt to circulate within a chamber. The dispensing mechanism further comprises a housing defining the chamber and defining an opening at the bottom of the chamber, such that a single item drops from between its respective paddles and through the opening when the segmented belt is incrementally advanced and the paddle supporting the item approaches a vertical orientation due to the advancement of the belt. In some embodiments, the actuator comprises a motor, a solenoid, or a memory metal. In some embodiments, the connector and actuator are comprised in a dispenser, and the belt, paddles, and housing are comprised in a cassette, and the dispensing mechanism further comprises a driving gear in the dispenser turned by the actuator and a driven gear in the cassette, the driven gear being driven by the actuator and causing the belt to be driven. In some embodiments, the dispenser and the cassette are separable, and the cassette does not include any active electrical components. In some embodiments, the dispenser further comprises a light emitter directed across the opening at the bottom of the chamber, and one or more receivers that detect light from the light emitter reflected from a far wall of the opening, the light emitter and the one or more receivers positioned such that the light detected by at least one of the one or more receivers is interrupted by the passage of a dispensed item through the opening. In some embodiments, the plurality of paddles comprises at least 32 paddles and the cassette displaces an overall volume of less than 900 cubic centimeters. In some embodiments, the cassette displaces less than 30 cubic centimeters for each item stored in the cassette at full capacity. In some embodiments, the cassette includes a wirelessly-readable memory and the dispenser includes a reader for reading the wirelessly-readable memory. In some embodiments, the belt is segmented and each of the plurality of paddles is integrally formed with a respective segment of the belt. In some embodiments, the plurality of paddles comprises at least 32 paddles. In some embodiments, the dispensing mechanism further comprises a sensor that directly measures motion of a mechanical component of the dispensing mechanism.

According to another aspect, a dispensing mechanism comprises a set of T-shaped vertical channels of a shape and size to receive cylindrical tops of a number of vials and hold the vials in vertical stacks, a connector for receiving electrical signals from a cabinet in which the dispensing mechanism is installed, an actuator that moves in response to the electrical signals, and a plurality of slotted gears driven by the actuator. Each of the slotted gears is positioned under a respective one of the T-shaped vertical channels and defines a T-shaped blind slot of a shape and size to receive the cylindrical top of a vial. The dispensing mechanism further comprises a housing defining opening at the bottom of the dispensing mechanism. When the slotted gears are driven, their respective T-shaped blind slots sequentially align with the T-shaped vertical channels, such that upon alignment, one of the cylindrical tops drops into the respective T-shaped blind slot capturing the respective vial. When one of the T-shaped blind slots holding a vial approaches a downward vertical orientation, a single vial drops from the downwardly-oriented T-shaped blind slot and through the opening. In some embodiments, the actuator comprises a motor, a solenoid, or a memory metal. In some embodiments, the dispensing mechanism comprises at least three g slotted ears, one of the slotted gears driving the others, the slotted gears meshed such that their T-shaped blind slots reach the downward vertical orientation at evenly spaced angular intervals of the driving gear. In some embodiments, the dispensing mechanism further comprises a light emitter directed across the opening and one or more receivers that detect light from the light emitter reflected from a far wall of the opening, the light emitter and the one or more receivers positioned such that the light detected by at least one of the one or more receivers is interrupted by the passage of a vial dispensed through the opening. In some embodiments, the T-shaped vertical channels are comprised in a cassette, and the connector, actuator, and slotted gears are comprised in a dispenser; the cassette and dispenser are separable; and the cassette does not include any active electrical components. In some embodiments, the cassette includes a wirelessly-readable memory and the dispenser includes a reader for reading the wirelessly-readable memory. In some embodiments, the cassette further comprises a latch that retains vials within the cassette when the cassette is separated from the dispenser, and that permits the vials to reach the T-shaped blind slots of the slotted gears when the cassette is assembled to the dispenser. In some embodiments, the cassette displaces less than 30 cubic centimeters for each vial stored in the cassette at full capacity. In some embodiments, the dispensing mechanism further comprises a sensor that directly measures motion of a mechanical component of the dispensing mechanism.

According to another aspect, a dispensing mechanism comprises a connector for receiving electrical signals from a cabinet in which the dispensing mechanism is installed, an actuator that moves in response to the electrical signals, a tray having an opening through which items are to be dispensed, and a moveable slide driven by the actuator. The moveable slide has slot through the movable slide, into which slot items to be dispensed fall one at a time. The dispensing mechanism further comprises a spring that biases the slide into a default position in which the slot of the moveable slide is not aligned with the opening in the tray. When the slide is moved by the actuator, the slide translates against the action of the spring into a position in which the slot in the slide aligns with the opening in the tray, allowing a single item in the slot to fall through the opening to be dispensed. In some embodiments, the actuator comprises a motor, a solenoid, or a memory metal. In some embodiments, the dispensing mechanism further comprises a movable guide that is engaged by the slide to rotate, permitting another item to reach the slot in the slide. In some embodiments, the motion of the guide also agitates a supply of items to be dispensed. In some embodiments, the dispensing mechanism further comprises a light emitter positioned to form a light curtain below the opening, and one or more receivers that detect light from the light emitter reflected from a surface opposite the light emitter, the light emitter and the one or more receivers positioned such that the light detected by at least one of the one or more receivers is interrupted by the passage of an item dispensed through the opening. In some embodiments, the connector, the actuator, and the cam are comprised in a dispenser, and the tray, and the slide, and the spring are comprised in a cassette that stores a supply of items to be dispensed; the dispenser and the cassette are separable; and the cassette does not include any active electrical components. In some embodiments, the cassette includes a wirelessly-readable memory, and the dispenser includes a reader for reading the wirelessly-readable memory. In some embodiments, the cassette has a capacity to hold at least 100 syringes each having a diameter of 10-12 mm and a length of 145-150 mm, and the cassette displaces an overall volume of less than 2600 cubic centimeters. In some embodiments, the cassette displaces less than 25 cubic centimeters for each item stored in the cassette at full capacity. In some embodiments, the dispensing mechanism further comprises a sensor that directly measures motion of a mechanical component of the dispensing mechanism.

DETAILED DESCRIPTION OF THE INVENTION

Figure 1:
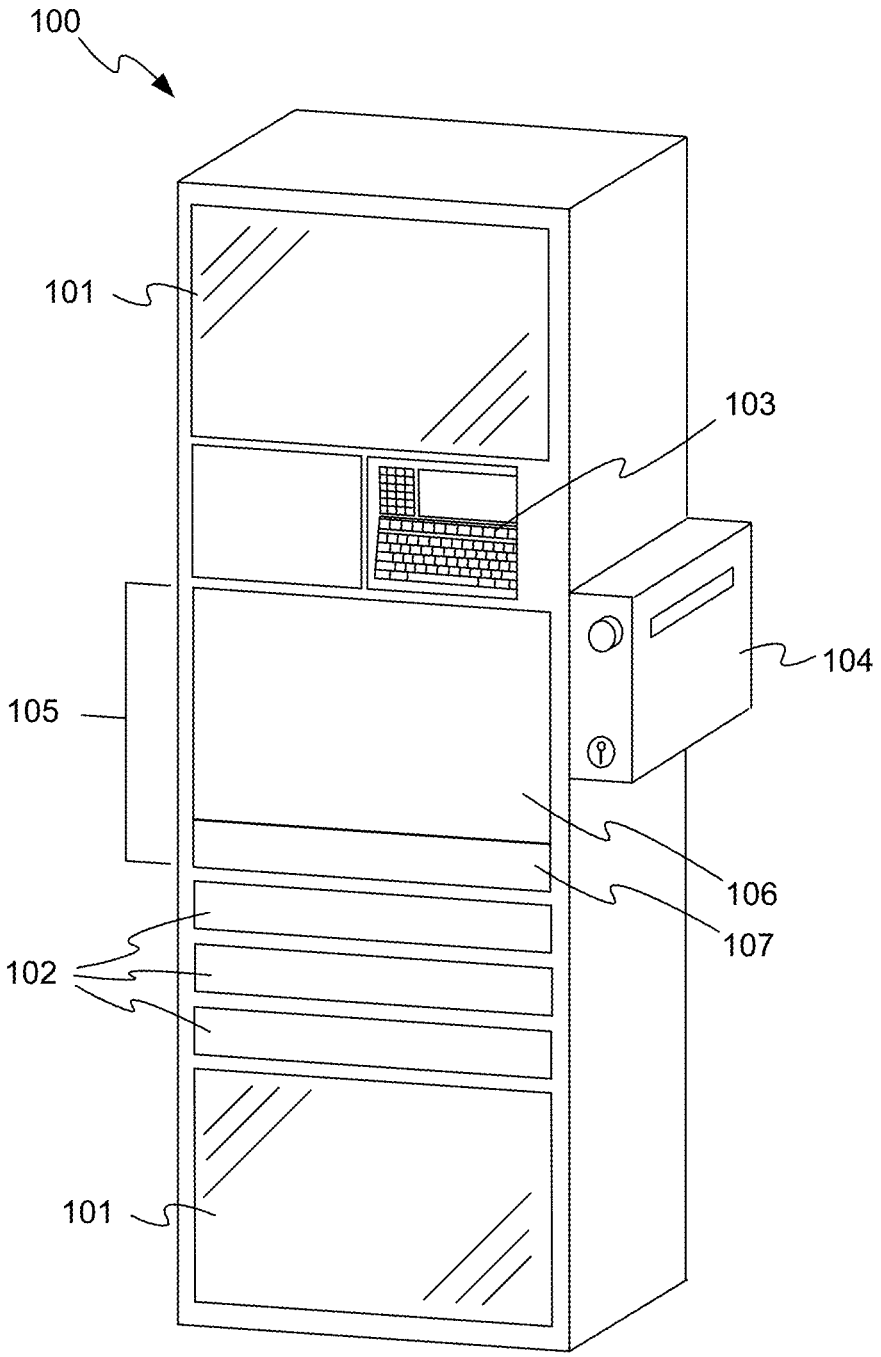
FIG. 1 illustrates an example cabinet in which the invention may be embodied.

FIG. 1 illustrates and example cabinet 100 in which the invention may be embodied. Cabinet 100 includes various doors 101 and drawers 102 providing access to compartments for storing items such as medical supplies or medications. For example, supplies such as bandages, swabs, and the like may be stored in unlocked compartments such as may be accessed through one of doors 101. Medications may be stored in individually lockable compartments within drawers such as drawers 102. A computer 103 maintains records of the contents of cabinet 100, and may control access to individual compartments. For example, a floor nurse needing to obtain a dose of medication for a hospital patient may enter his or her identification and the medication required into computer 103. Computer 103 verifies that the nurse is authorized to remove the medication, and unlocks a particular drawer 102 and a particular compartment within the drawer containing the required medication. Computer 103 may also control lights that guide the nurse to the correct drawer and compartment, to help ensure that the correct medication is dispensed. In addition, computer 103 may communicate with a central computer system that coordinates information from many storage and dispensing devices such as cabinet 100.

While embodiments of the invention are described in the context of stationary cabinet 100, it will be recognized that the invention may be embodied in other kinds of storage devices, for example movable cabinets, carts, storage rooms, and the like. Example dispensing devices are described in the following commonly owned U.S. Patents and patent applications, the contents of which are hereby incorporated by reference: U.S. Pat. No. 6,272,394, issued on Aug. 7, 2001 to Lipps, U.S. Pat. No. 6,385,505, issued on May 7, 2002 to Lipps, U.S. Pat. No. 6,760,643, issued on Jul. 6, 2004 to Lipps, U.S. Pat. No. 5,805,455, issued on Sep. 8, 1998 to Lipps, U.S. Pat. No. 6,609,047, issued on Aug. 19, 2003 to Lipps, U.S. Pat. No. 5,805,456, issued on Sep. 8, 1998 to Higham et al., U.S. Pat. No. 5,745,366, issued on Apr. 28, 1998 to Higham et al., an U.S. Pat. No. 5,905,653, issued on May 18, 1999 to Higham et al., U.S. Pat. No. 5,927,540, issued on Jul. 27, 1999 to Godlewski, U.S. Pat. No. 6,039,467, issued on Mar. 21, 2000 to Holmes, U.S. Pat. No. 6,640,159, issued on Oct. 28, 2003 to Holmes et al., U.S. Pat. No. 6,151,536, issued on Nov. 21, 2000 to Arnold et al., U.S. Pat. No. 5,377,864, issued on Jan. 3, 1995 to Blechl et al., U.S. Pat. No. 5,190,185, issued on Mar. 2, 1993 to Blechl, U.S. Pat. No. 6,975,922, issued on Dec. 13, 2005 to Duncan et al., U.S. Pat. No. 7,571,024, issued on Aug. 4, 2009 to Duncan et al., U.S. Pat. No. 7,835,819, issued on Nov. 16, 2010 to Duncan et al., U.S. Pat. No. 6,011,999, issued on Jan. 4, 2000 to Holmes, U.S. Pat. No. 7,348,884, issued on Mar. 25, 2008 to Higham, U.S. Pat. No. 7,675,421, issued on Mar. 9, 2010 to Higham, U.S. Pat. No. 6,170,929, issued on Jan. 9, 2001 to Wilson et al., U.S. Pat. No. 8,155,786 to Vahlberg et al., issued on Apr. 10, 2012, U.S. Pat. No. 8,073,563 to Vahlberg et al., issued on Dec. 6, 2011, U.S. Patent Application Publication No. 2008/0319577 of Vahlberg et al., published on Dec. 25, 2008, U.S. Pat. No. 8,140,186 to Vahlberg et al., issued on Mar. 20, 2012, U.S. Pat. No. 8,126,590 to Vahlberg et al., issued on Feb. 28, 2012, U.S. Pat. No. 8,027,749 to Vahlberg et al., issued on Sep. 27, 2011, U.S. Patent Application Publication No. 2008/0319790 of Vahlberg et al., published on Dec. 25, 2008, U.S. Patent Application Publication No. 2008/0319789 of Vahlberg et al., published on Dec. 25, 2008, U.S. Pat. No. 8,131,397 to Vahlberg et al., issued on Mar. 6, 2012, U.S. Patent Application Publication No. 2008/0319579 of Vahlberg et al., published on Dec. 25, 2008, and U.S. Patent Application Publication No. 2010/0042437 of Levy et al., published on Feb. 18, 2010. Embodiments of the present invention may incorporate features from the devices described in these documents, in any workable combination.

In the above scenario, the nurse may be given access to a compartment having a large number of doses of the medication, and he or she may simply remove the number immediately required.

Cabinet 100 also includes a return bin 104, into which unused items can be placed, for later return to stock by a pharmacy technician.

When further control and tracking accuracy is required, medications may be placed in a dispensing unit such as dispensing unit 105. Dispensing unit 105 includes a restock drawer 106 and a dispense drawer 107. Restock drawer includes in turn a number of dispensing mechanisms (not visible in FIG. 1) that, under control of computer 103, can dispense single items into dispense drawer 107. Dispense drawer 107 can then be opened to retrieve the dispensed items. Restock drawer 106 is accessible only by specially-authorized persons, for example for restocking by a pharmacy technician.

Figure 2:
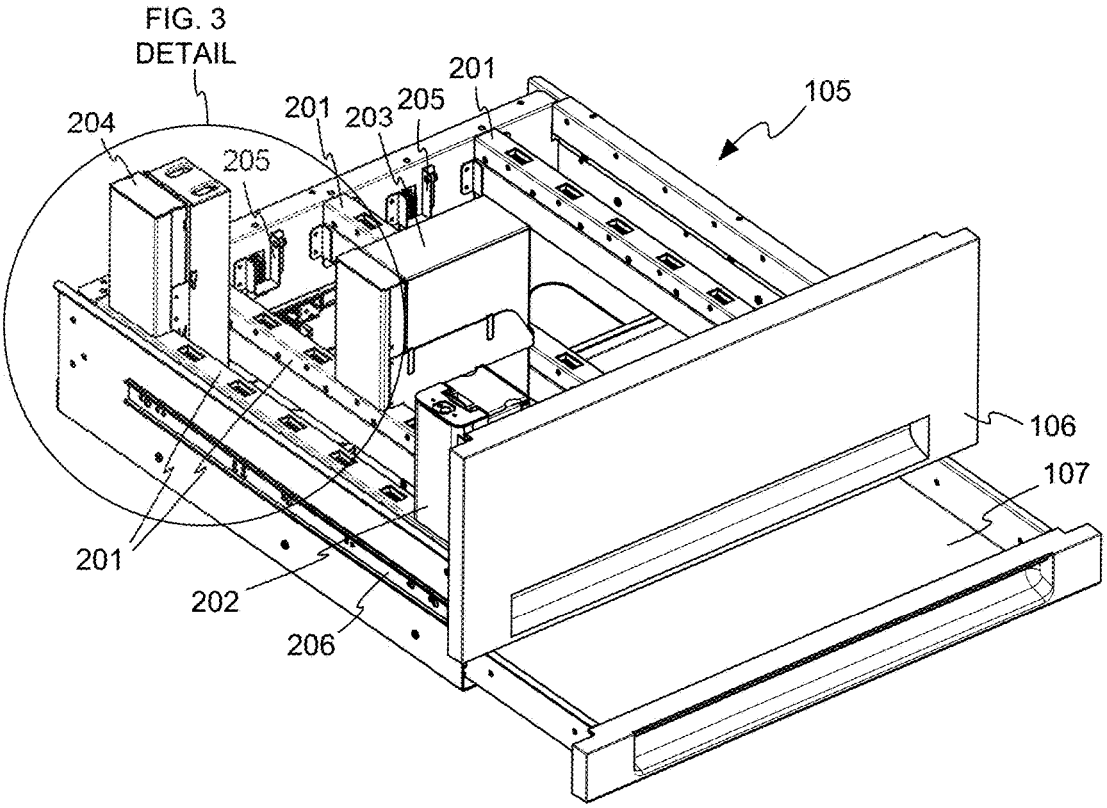
FIG. 2 illustrates a dispensing unit in accordance with embodiments of the invention.

FIG. 2 illustrates dispensing unit 105 in more detail, including restock drawer 106 and dispense drawer 107. A number of dispensing mechanisms may be installed within restock drawer by 106 attaching them to rails 201. Only a few dispensing mechanisms 202, 203, 204 are shown in FIG. 2. Different types of dispensing mechanisms may be present, depending on the kinds of items to be dispensed, as is discussed in more detail below. The different kinds of dispensers may be of differing sizes, and rails 201 may be configured as necessary to accommodate a particular mix of dispensing mechanisms, by fixing rails 201 to different sets of hangers 205.

For example, dispensing mechanism 203 is a double width mechanism, placed between rails that are two bays wide, while dispensing mechanisms 202 and 204 are single width mechanisms, placed between rails 201 that are connected to adjacent sets of hangers 205. Other sizes of dispensers, for example triple and quadruple widths are also possible.

FIG. 2 also illustrates that dispense drawer 107 and restock drawer 106 form a nested pair of drawers. That is, restock drawer 106 can slide out of cabinet 100 on guides 206 for restocking, maintenance, and the like, carrying dispense drawer 107 with restock drawer 106. Similarly, dispense drawer 107 can slide in and out of restock drawer 106 on similar guides not easily visible in FIG. 2.

In some embodiments, dispense drawer 107 may conveniently serve as a work surface for the user of cabinet 100 or a similar device. For example, once an item has been dispensed into dispense drawer 107 and the user has opened dispense drawer 107 to retrieve the item, the user may use the flat bottom of dispense drawer 107 to rest a note pad, computer, or other item he or she may use to document or make notes about the transaction. Dispensing unit 105 may include features to facilitate the use of dispense drawer 107 as a work surface. For example, the guides or other slide mechanism by which dispense drawer opens may include a detent at the openmost position of dispense drawer 107, to lend stability to dispense drawer 107 while it is used as a work surface.

Figure 3:
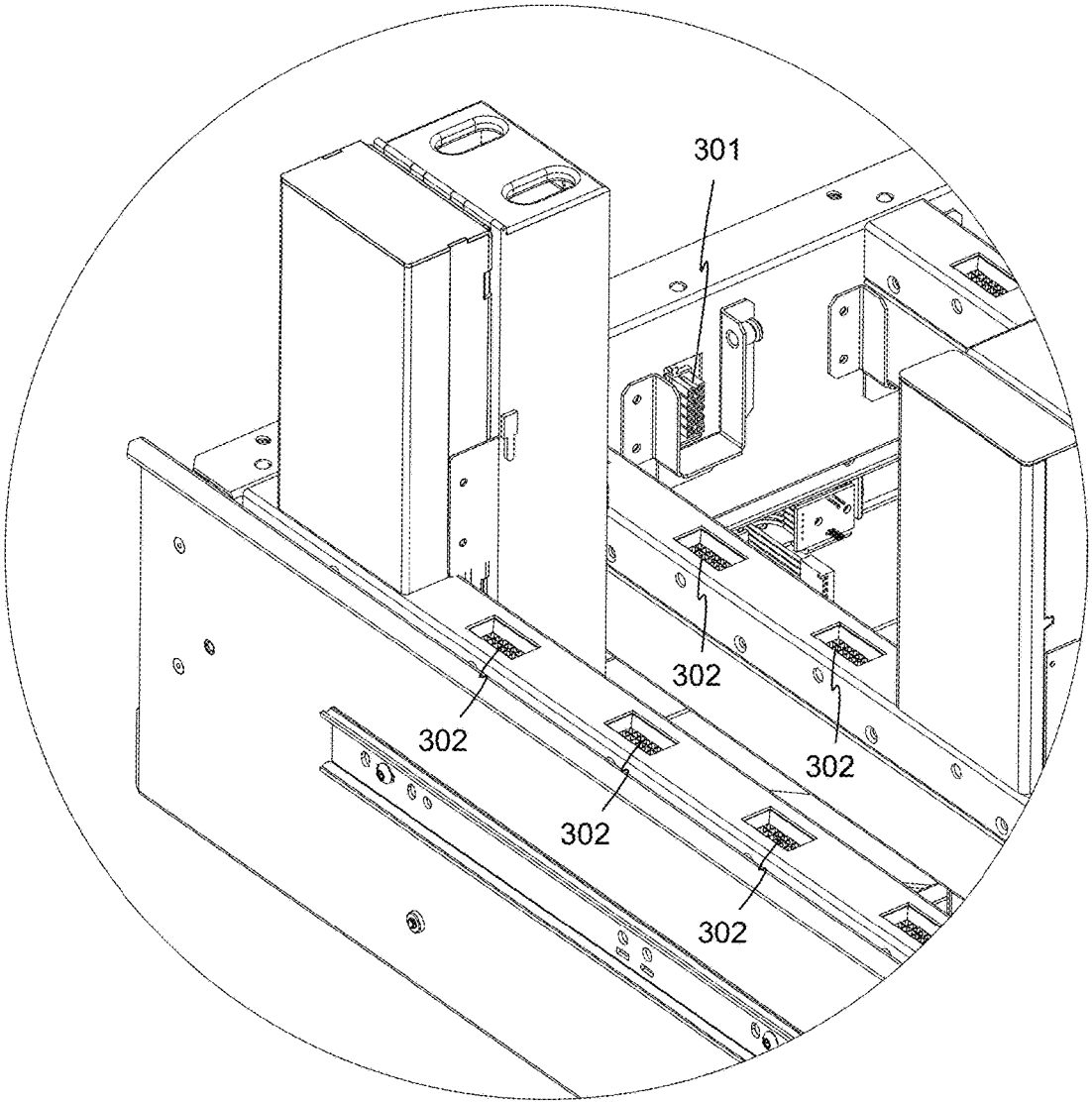
FIG. 3 is a detail view of a portion of FIG. 2.

FIG. 3 is a detail view of a portion of FIG. 2, showing that at each hanger 205 is an electrical connector 301. Each connector 301 connects with a mating connector attached to wiring within a rail 201 positioned at the respective hanger 205, supplying power and signals coming from other systems within cabinet 100. Other connectors 302 are spaced along the rails, for making electrical connections with the dispensing mechanisms such as dispensing mechanisms 202, 203, and 204. To accomplish the required electrical connections, each rail 201 may house a wiring harness, a printed circuit board assembly (PCBA), or the like. Thus, computer 103 can communicate individually with any dispensing mechanism within restock drawer 106. Cabling from all of the connectors converges at a circuit board (not visible) at the back of dispensing unit 105, which in turn connects to other electronics within cabinet 100 via one or more flexible cables (not visible in FIG. 3), which permits dispensing unit 105 to slide out of cabinet 100 for restocking, maintenance, and the like.

Figure 4A:
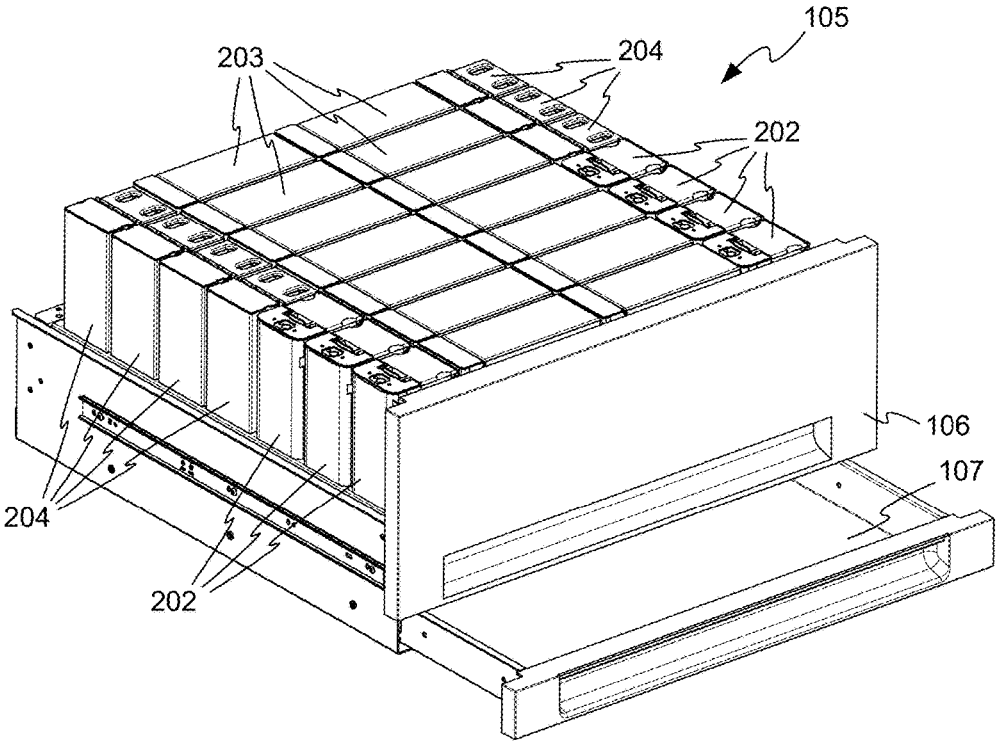
FIG. 4A illustrates the dispensing unit of FIG. 2 fully loaded with dispensing mechanisms.
Figure 4B:
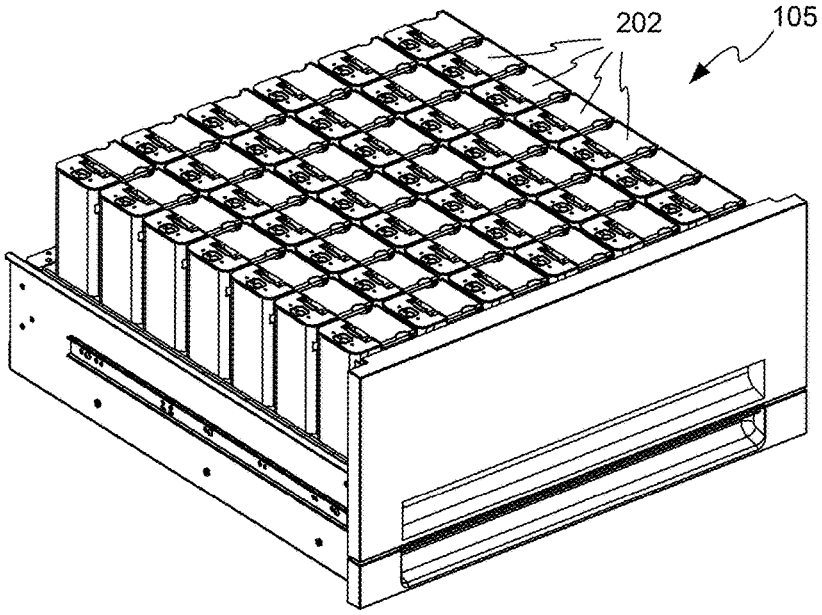
FIG. 4B illustrates the dispensing unit of FIG. 2 fully loaded with a different mix of dispensing mechanisms.

FIG. 4A illustrates dispensing unit 105 fully loaded with seven dispensing mechanisms 202, 14 dispensing mechanisms 203, and seven dispensing mechanisms 204, fully populating the available spaces on rails 201. It will be recognized that this arrangement of dispensing units is but one example of many, many arrangements of dispensing units that could be employed. For example, restock drawer 106 may not be fully populated with dispensing units. Only one or two different kinds of dispensing mechanisms may be present, or four or more kinds of dispensing units may be present. Different kinds of dispensing units may be present in any workable proportions, and like dispensing units need not be installed next to each other. Example dispensing unit 105 can hold up to 42 single width dispensing mechanisms (with two additional rails 201 installed). One example of this is shown in FIG. 4B, in which dispensing unit is loaded with 42 dispensers 202.

Preferably, each dispensing unit can identify itself through its respective connector 302, and computer 103 can create a map of the particular arrangement of dispensing units that are installed. Computer 103 can also preferably detect the presence of a dispensing unit at any one of the bay positions, through the respective connector 302 or via a separate sensor. In addition, each dispensing unit can preferably also communicate to computer 103 the kind and quantity of items it contains and stands ready to dispense.

Figure 5:
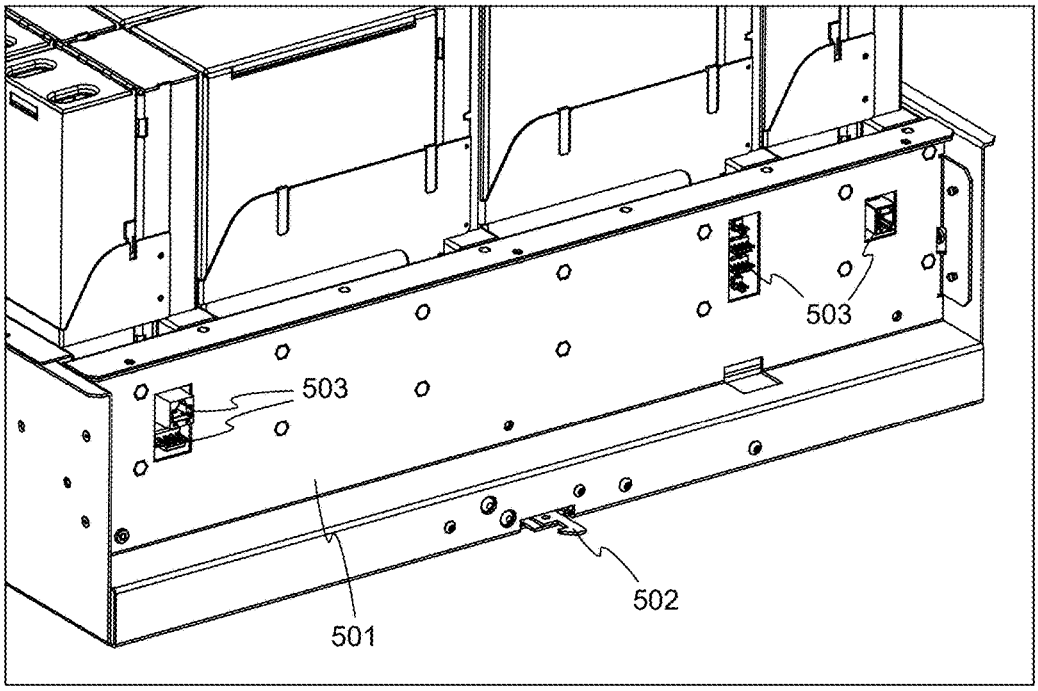
FIG. 5 is a reverse angle view of a portion of the fully-loaded dispensing unit of FIG. 4A.

FIG. 5 is a reverse angle view of a portion of the fully-loaded dispensing unit 105 of FIG. 4A, showing a back panel 501 of restock drawer 106. Preferably, both restock drawer 106 and dispense drawer 107 include latching mechanisms operable by computer 103, to prevent the opening of the drawers at improper times. For example, computer 103 may permit restock drawer 106 to be opened only when computer 103 has received a proper security code from a restocking technician, and may permit dispense drawer 107 to be opened only after an item has been dispensed from one of dispensing mechanisms 202, 203, 204. A latching mechanism 502 for locking and unlocking restock drawer 106 is visible in FIG. 5. A similar latching mechanism may be provided inside restock drawer 106 for locking and unlocking dispense drawer 107. Also visible in FIG. 5 are various connectors 503 for connecting to other electronics within cabinet 100, for example a power supply, computer 103, or other electronic components through one or more flexible cables (not shown).

Dispensing Mechanisms

The dispensing mechanisms 202, 203, 204 may be tailored to the size and type of items to be dispensed, and provide improvements over prior dispensing mechanisms. For example, one prior type of dispensing mechanism used a helical coil, and items to be dispensed were positioned between the coils of the helix. The coil was rotated until an item was advanced beyond the grasp of the coil and was dispensed. This kind of dispenser, although widely and successfully used, is somewhat limited in the shapes and sizes of items that could be dispensed, as the items must be compatible with the pitch and size of the coil.

Dispensing Mechanism for Blister Packs and Other Small Items

Figure 6A:
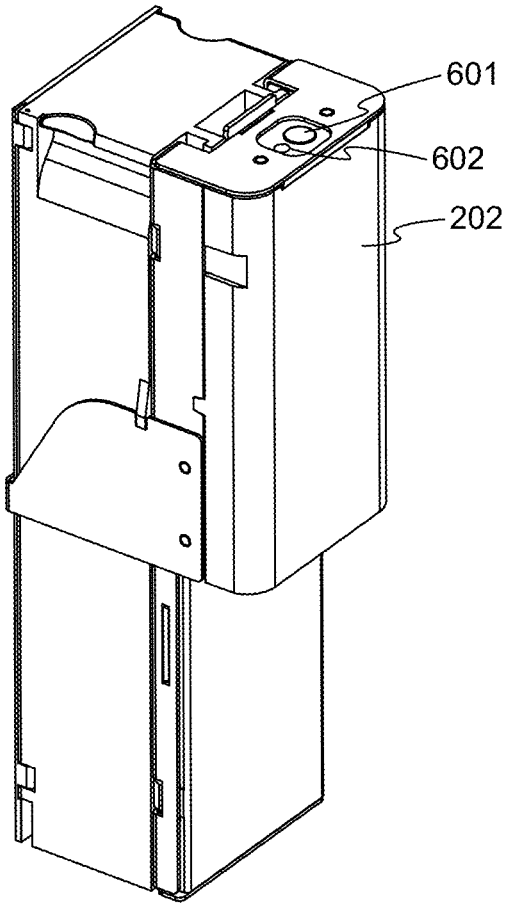
FIGS. 6A and 6B illustrate upper and lower views of a first dispensing mechanism in accordance with embodiments of the invention.
Figure 6B:
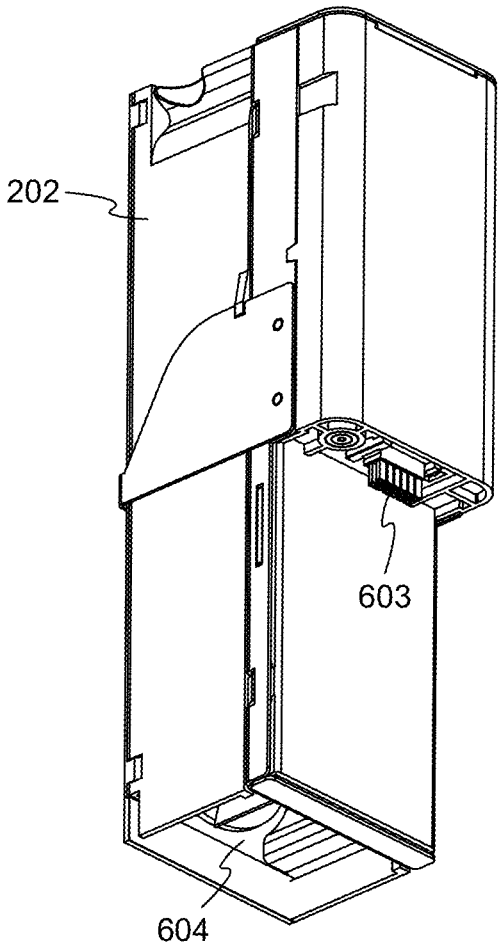

FIGS. 6A and 6B illustrate upper and lower views of dispensing mechanism 202 in more detail. Dispensing mechanism 202 may be especially useful for dispensing small items such as individual medicine doses packaged in well-known "blister packs", although dispensing mechanism 202 may be useful for dispensing may other kinds of items as well.

As is visible in FIG. 6A, a button 601 at the top of dispensing mechanism 202 allows a user authorized to access the interior of restock drawer 106 to signal computer 103, for example to record the fact that dispensing mechanism 202 has been refilled. A light 602 enables computer 103 to communicate to the user, for example flashing the light to direct the user to restock this particular dispensing mechanism.

As is visible in FIG. 6B, a connector 603, compatible with connectors 302 on rails 201, is positioned to engage one of connectors 302 when dispensing mechanism 202 is installed in restock drawer 106. Various parts of dispensing mechanism 202 collectively constitute a housing that defines an opening 604 at the bottom of dispensing mechanism 202, through which items are dispensed. Dispensing mechanism 202 may be removably secured to one of rails 201 using a snap mechanism, one or more screws, or by another method.

Figure 7B:
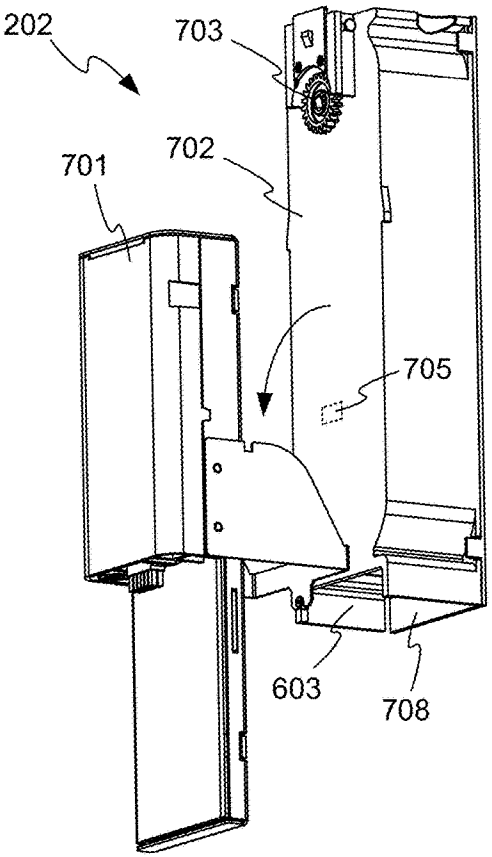
FIGS. 7A and 7B illustrate partially exploded views of the dispensing mechanism of FIGS. 6A and 6B.
Figure 7A:
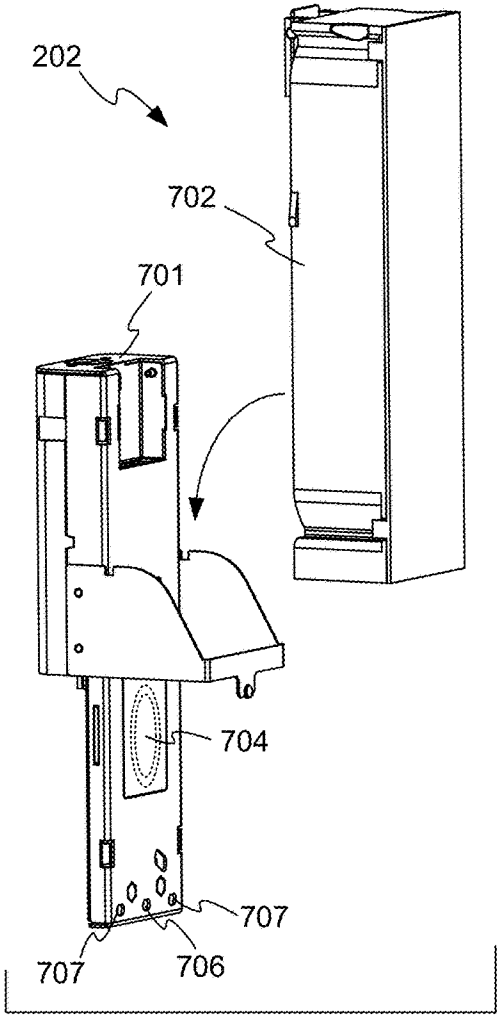

As is shown in FIGS. 7A and 7B, example dispensing mechanism 202 comprises a dispenser 701 and a cassette 702, which are separable. For example, dispenser 701 and cassette 702 may snap together, may be separable with the removal of one or a small number of screws, or may be reasonably separable in some other way without damage to either dispenser 701 or cassette 702. In this way, restocking may be accomplished by replacing a depleted cassette 702 with a full cassette 702. A gear 703 engages a driving gear (not easily visible in FIG. 7A) within dispenser 701 when cassette 702 is assembled to dispenser 701.

Preferably, as will be discussed in more detail below, cassette 702 does not contain any active electrical components. All of the active components of example dispensing mechanism 202 reside in dispenser 701. For example, an antenna 704 can excite a passive memory chip 705 in cassette 702, to determine the contents of cassette 702 (written into passive memory chip 705 when cassette 702 was filled at a remote location). If desired, antenna 704 can also be used to update the data in passive memory chip 705. This wireless data exchange may use any suitable wireless protocol, for example Near Field Communications (NFC), radio frequency identification (RFID), or another wireless protocol.

Dispenser 701 can preferably automatically detect the installation and removal of cassette 702. This automatic detection may facilitate the inventory and tracking of items, and also can help prevent illicit diversion of items. The detection may be accomplished in any suitable way, for example periodic polling using antenna 704, a contact sensor (not shown) that can detect the presence of cassette 702 electromechanically, or by another technique.

As are visible in FIG. 7A, a light emitter 706 and two light receivers 707 are positioned near the bottom of dispenser 701. In operation, light from light emitter 706 reflects from reflective surface 708 (visible in FIG. 7B) and returns to light receivers 707, so long as it is not interrupted by an item being dispensed and falling through the "light curtain" formed across opening. When an item is dispensed through opening 604, it interrupts the light received by either or both of light receivers 707, and dispenser 701 can note that an item has in fact been dispensed. If no light interruption is detected despite a command to dispense an item, computer 103 may assume that a misfeed or other problem has occurred, or that cassette 702 is empty. By using more sophisticated monitoring strategies, accidental dispensing of multiple items may be detected. For example, if two interruptions of the light curtain are detected closely spaced in time, a double feed may be indicated. Emitter 706 may be of any suitable type of emitter, and may emit light in any suitable wavelength or combinations of wavelengths. For example, light emitter 706 may be a light emitting diode, a laser such as a vertical cavity semiconductor emitting laser (VCSEL) or another kind of light source, and may emit visible light, infrared light, or light in other suitable wavelength bands or combinations of wavelength bands.

Figure 8:
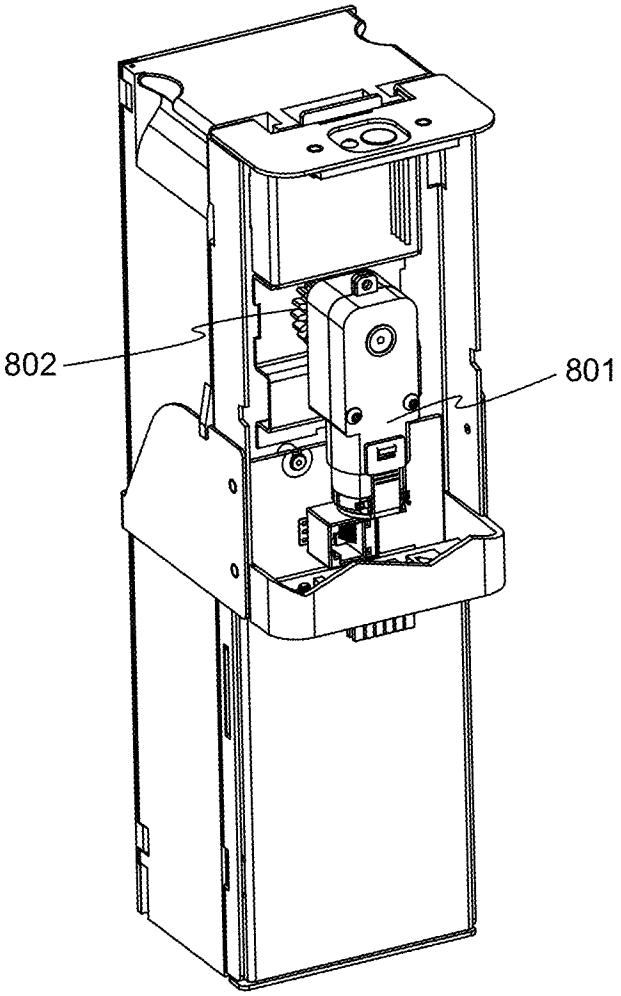
FIG. 8 shows a partially cutaway oblique view of the dispensing mechanism of FIGS. 6A and 6B.

FIG. 8 shows a partially cutaway oblique view of dispensing mechanism 202, revealing some internal details of dispenser 701. A motor 801 having a right-angle drive turns driving gear 802, which engages gear 703 on cassette 702 to actuate cassette 702. Motor 801 may be, for example, a stepper motor whose angular position can be readily moved incrementally and held. In that case, an item may be dispensed by advancing motor 801 by a number of steps known to correspond to one dispensing operation. If the light curtain does not detect that an item is dispensed, motor 801 may be advanced further, and if no dispensing is yet detected, and error message may be generated, or it may be assumed that cassette 702 is empty. Alternatively, motor 801 may be a simple DC or AC motor, in which case dispensing may be accomplished by simply running motor 801 until the dispensing of an item is detected, and then shutting off the motor so that motor 801 is advanced incrementally as far as is needed. A time limit may be imposed, such that if no dispensing is detected within the time limit with motor 801 running, the motor may be shut off and an error message generated.

In other embodiments, an actuator other than a motor may be used. For example, a solenoid or memory metal actuator may provide a reciprocating motion that is used to drive the driving gear within dispenser 701 using a ratchet or ratchet-like arrangement. Other kinds of actuators and driving arrangements are possible.

A microprocessor, microcontroller, or similar controlling circuitry may reside within dispenser 701, and may operate the various active components and sensors of dispenser 701 in response to high-level commands from a supervisory controller elsewhere within restock drawer 106, or from computer 103. In that case, dispenser 701 is considered a "smart" dispenser, because it includes some processing intelligence. However, other architectures are possible. For example, logic signals from a supervisory controller elsewhere within restock drawer 106 may operate dispenser 701.

Figure 9:
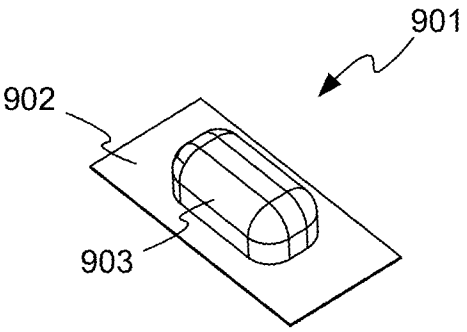
FIG. 9 illustrates a typical blister pack as may be dispensed by the dispensing mechanism of FIGS. 6A and 6B.

As was discussed above, dispensing mechanism 202 may be especially useful for dispensing individual medicine doses such as those commonly packaged in blister packs. FIG. 9 illustrates a typical blister pack 901. A flat portion 902 may be made of cardboard, a stiff plastic, or the like. A plastic bubble-like "blister" 903 is laminated to flat portion 902, with a capsule or the like (not visible) confined within blister 903.

Figure 10:
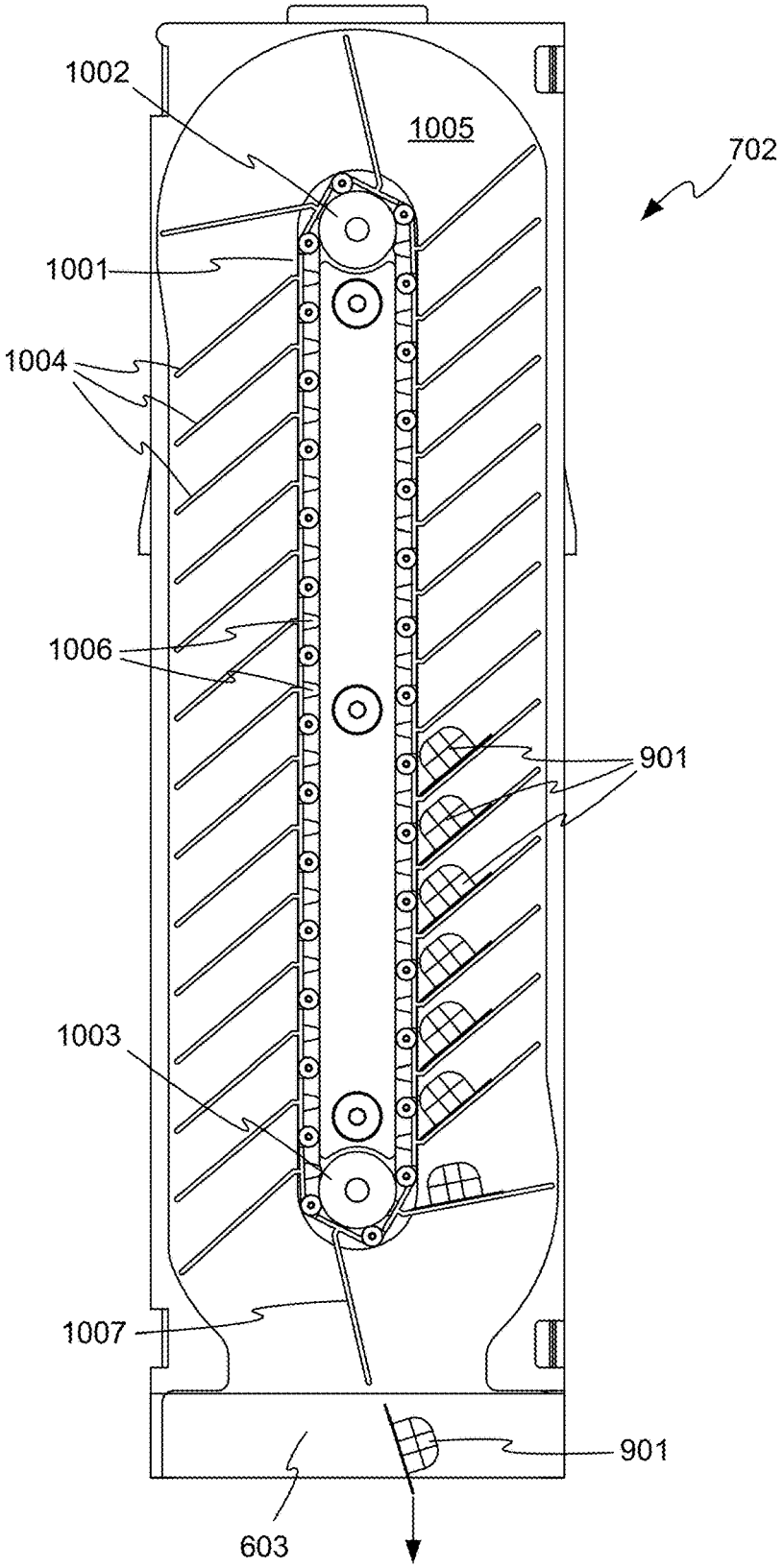
FIG. 10 shows an orthogonal view of a cassette portion of the dispensing mechanism of FIGS. 6A and 6B, with a back cover removed to show some internal workings of the cassette.

FIG. 10 shows an orthogonal view of cassette 702, with its back cover removed, and showing the internal workings of the cassette. A segmented belt 1001 is supported between drive shaft 1002 and idler shaft 1003. Drive shaft 1002 is connected to gear 802, such that belt 1001 is driven by gear 802, and ultimately by motor 801. Motor 801 (and thus belt 1001) may be driven in either direction. Paddles 1004 are integrally formed with segments of belt 1001, and circulate within chamber 1005 as the belt moves. Recesses within drive shaft 1002 and idler shaft 1003 (not visible) engage with teeth 1006 formed on the inner surface of belt 1001, providing positive relationship between the angular position of drive shaft 1002 and the travel of belt 1001.

Other arrangements are possible. For example, belt 1001 could be a continuous belt rather than a segmented belt, and paddles 1004 could be attached to the belt rather than being integrally formed with it.

The spaces between paddles 1004 form a number of storage compartments, some of which are filled with blister packs 901. To dispense an item, belt 1001 is incrementally advanced until the bottommost paddle 1004 holding an item approaches a vertical orientation, as shown by paddle 1007, and the item falls by gravity through opening 604 to dispense drawer 107.

While chamber 1005 is shown as being oriented vertically (being taller than it is wide), this is not a requirement. A dispensing mechanism according to embodiments of the invention may also position a chamber in a horizontal orientation (being wider than it is tall).

Figure 11:
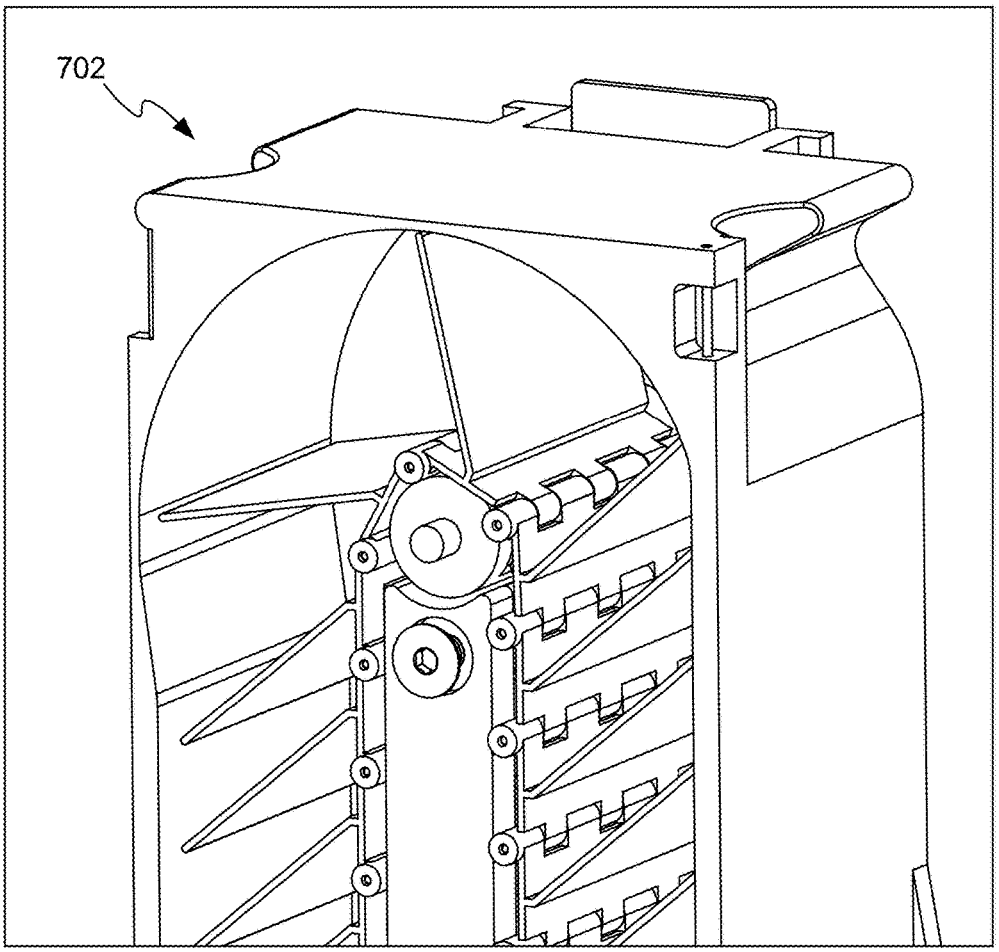
FIG. 11 is an oblique detail view of the upper portion of the cassette of FIG. 10, providing more detail about the construction of the cassette.

FIG. 11 is an oblique detail view of the upper portion of cassette 702, providing more detail about the construction of cassette 702.

The use of paddles 1004 in this manner provides the ability to store a large number of items to be dispensed, in comparison with prior cassette designs, for example the prior helical screw dispenser. Example cassette 702 uses 32 paddles 1004, providing storage for up to 30 items between paddles 1004. More or fewer paddles 1004 could be used, providing a different number of storage spaces, depending on the sizes of the items to be placed in and dispensed from the cassette. While other dimensions are possible, example cassette 702 is approximately 251 mm tall, 72 mm wide, and 49 mm deep, and thus displaces a volume of less than 900 cubic centimeters, or about 30 cubic centimeters for each item that can be stored in cassette 702. In other embodiments, more items may be stored by placing paddles 1004 closer together, making paddles 1004 smaller, or by other miniaturization techniques. For example, in various embodiments, cassette 702 may displace, less than 30, less than 25, less than 20, less than 15, or less than 10 cubic centimeters for each item stored in cassette 702 at full capacity.

In some embodiments, dispensing mechanism 202 may include one or more sensors for directly detecting movement of a mechanical component of dispensing mechanism 202. For example, the driving gear within dispenser 701 may have holes around its main portion, so that the remaining material between the holes functions as broad spokes. A reflective optical sensor may be provided within dispenser 701 that shines light (for example infrared light) onto the driving gear and can detect whether a return reflection is received. Rotation of the gear then results in an alternating signal from the sensor as the reflective "spokes" and the non-reflective holes alternately pass the sensor. A processor or other circuitry within dispenser 701 can interpret this signal to verify the motion of the driving gear. This direct measurement provides additional feedback as to the operation of dispensing mechanism 202. For example, if it is verified using the additional sensor that belt 1001 has moved sufficiently far that an item should be dispensed, but the light curtain sensor does not detect the dispensing of an item, it may be determined that cassette 702 is empty, or it may be suspected that an error has occurred.

Other kinds of sensors could be used to directly measure mechanical motion. For example, the passing of paddles 1004 may be detected by a reflective optical sensor shining light through an opening the wall of chamber 1005. Preferably, any active parts of the sensing system reside in dispenser 701, so that cassette 702 does not include active electrical components.

Dispensing Mechanism for Vials and Other Similarly-Shaped Items

Figure 13:
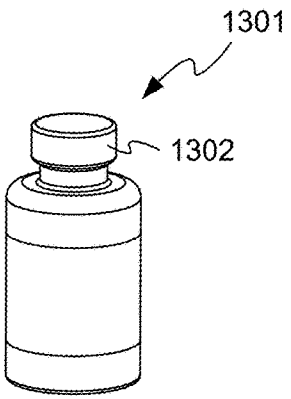
FIG. 13 illustrates a vial as may be dispensed by the dispensing mechanism of FIGS. 12A and 12B.
Figure 12B:
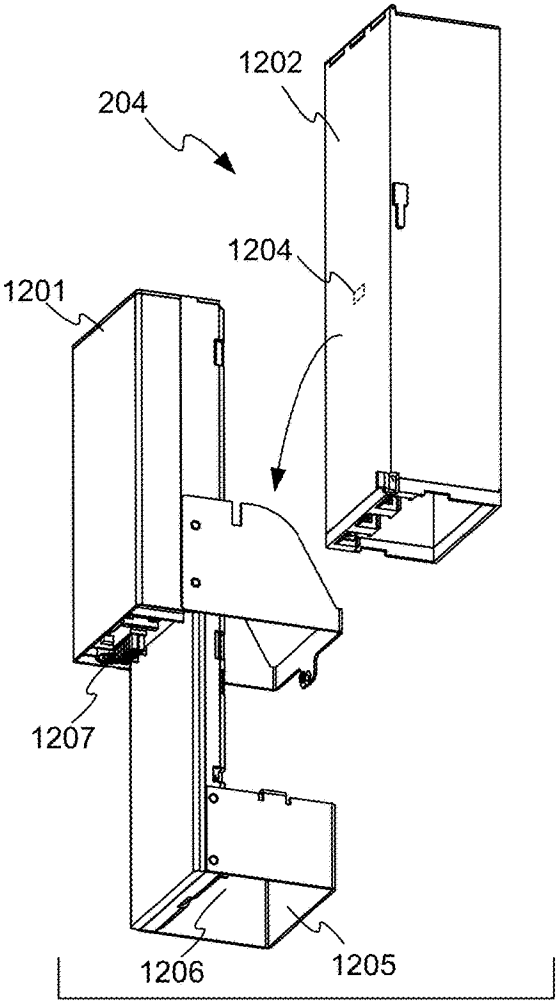
FIGS. 12A and 12B illustrate upper and lower partially exploded oblique views of a second dispensing mechanism in accordance with embodiments of the invention.
Figure 12A:
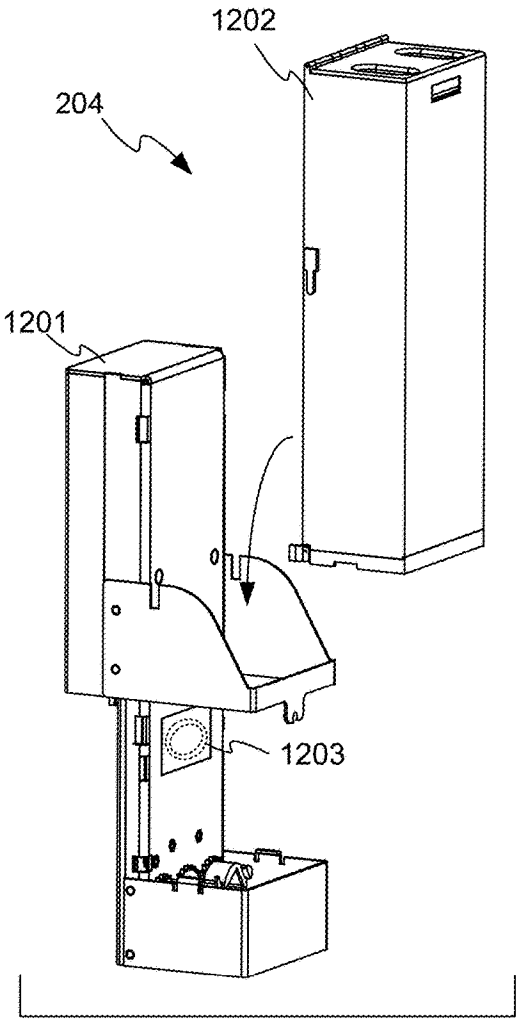

FIGS. 12A and 12B illustrate upper and lower partially exploded oblique views of dispensing mechanism 204. Dispensing mechanism 204 may be especially useful in dispensing vials such vial 1301 shown in FIG. 13, having a protruding cylindrical top 1302. Vial 1301 may be used, for example, for storing fluids for loading into a hypodermic syringe for injection into a patient. Other similarly-shaped items may also be dispensed by dispensing mechanism 204.

Referring again to FIGS. 12A and 12B, example dispensing mechanism includes a dispenser 1201 and a cassette 1202, which may be easily separable for restocking dispensing mechanism 204.

Preferably, cassette 1202 does not contain any active electrical components. All of the active components of dispensing mechanism 204 reside in dispenser 1201. For example, an antenna 1203 can excite a passive memory chip 1204 in cassette 1202, to determine the contents of cassette 1202 (written into passive memory chip 1204 when cassette 1202 was filled at a remote location). If desired, antenna 1203 can also be used to update the data in passive memory chip 1204. This wireless data exchange may use any suitable wireless protocol, for example Near Field Communications (NFC), radio frequency identification (RFID), or another wireless protocol.

Dispenser 1201 can preferably automatically detect the installation and removal of cassette 1202. This automatic detection may facilitate the inventory and tracking of items, and also can help prevent illicit diversion of items. The detection may be accomplished in any suitable way, for example periodic polling using antenna 1203, a contact sensor (not shown) that can detect the presence of cassette 1202 electromechanically, or by another technique. Dispensing mechanism 204 may be removably secured to one of rails 201 using a snap mechanism, one or more screws, or by another method.

Although not visible in FIGS. 12A and 12B, a light emitter and light receivers are positioned near the bottom of dispenser 1201, and operate similarly to light emitter 706 and receivers 707 described above with respect to dispensing mechanism 202. In operation, light from the light emitter reflects from reflective surface 1205 (visible in FIG. 12B) and returns to the light receivers, so long as it is not interrupted by an item being dispensed and falling through the "light curtain" formed across opening 1206. When an item is dispensed through opening 1206, it interrupts the light received by either or both light receivers, and dispenser 1201 can note that an item has in fact been dispensed. If no light interruption is detected despite a command to dispense an item, computer 103 may assume that a misfeed or other problem has occurred, or that cassette 1202 is empty. By using more sophisticated monitoring strategies, accidental dispensing of multiple items may be detected. For example, if two interruptions of the light curtain are detected closely spaced in time, a double feed may be indicated.

As is visible in FIG. 12B, a connector 1207, compatible with connectors 302 on rails 201, is positioned to engage one of connectors 302 when dispensing mechanism 204 is installed in restock drawer 106. Although not shown in FIGS. 12A and 12B, dispensing mechanism 204 may include a button and light similar to button 601 and light 602 discussed above, for communication between a restocking technician or other user and computer 103 of cabinet 100.

Figure 14:
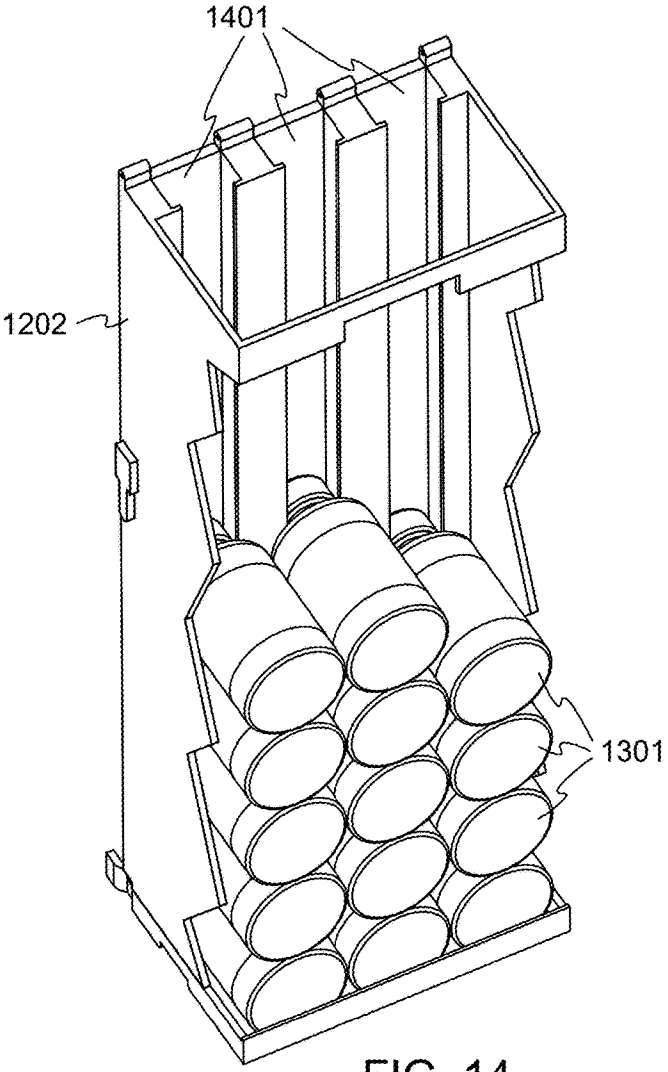
FIG. 14 is a cutaway oblique view of a cassette portion of the dispensing mechanism of FIGS. 12A and 12B, partially filled with vials.

FIG. 14 is a cutaway oblique view of example cassette 1202, partially filled with vials 1301, and with the top of cassette 1202 removed. As is visible in FIG. 14, cassette 1202 includes a number of T-shaped vertical channels 1401 of a shape and size to receive cylindrical tops 1302 of a number of vials 1301 and hold the vials in vertical stacks. Vials 1301 may be, for example, 5 ml vials, having a diameter of about 22 mm, a height of about 42.5 mm. While other dimensions may be used, example cassette 1202 is about 212 mm high, 72 mm wide, and 49 mm deep (displacing about 750 cubic centimeters), and can hold 27 vials of the 5 ml size. Thus, example cassette 1202 displaces less than 28 cubic centimeters for each vial that can be stored in cassette 1202. In other uses, 1 ml vials may be used, having a diameter of about 15 mm, in which case cassette 1202 may hold about 39 of the 1 ml vials, for a displacement of less than 20 cubic centimeters for each vial that can be stored in cassette 1202. Other vial sizes may be used as well. The protruding cylindrical tops of the various vial sizes are preferably similar enough that any compatible size vial can be retained by vertical channels 1401. In various embodiments, cassette 1202 may displace less than 30, less than 25, less than 20, or less than 15 cubic centimeters for each vial stored in cassette 1202 at full capacity.

Figure 15:
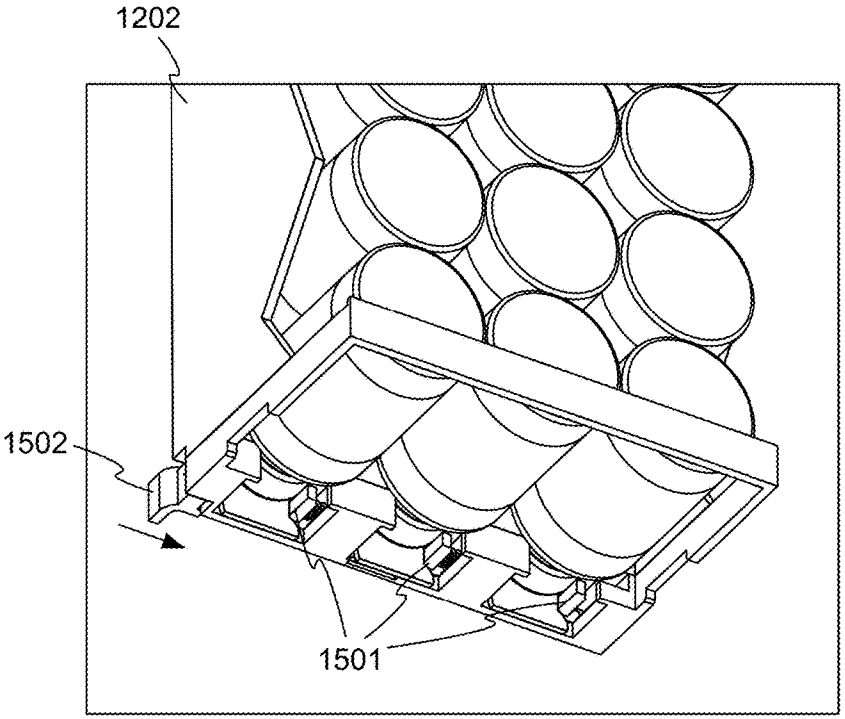
FIG. 15 illustrates a lower oblique view of the cassette portion of FIG. 14.

FIG. 15 illustrates a lower oblique view of loaded cassette 1202, showing spring-loaded latches 1501. While cassette 1202 is separated from dispenser 1201, latches 1501 partially block T-shaped channels 1401, preventing vials 1301 from falling out of cassette 1202. Latches 1501 are connected to a latch release 1502, which when actuated in the direction shown, moves latches out of channels 1401. When cassette 1202 is installed in dispenser 1201, latch release 1502 can be moved and restrained, so that vials 1301 are free to travel down T-shaped channels 1401, as is described in more detail below.

Figure 16:
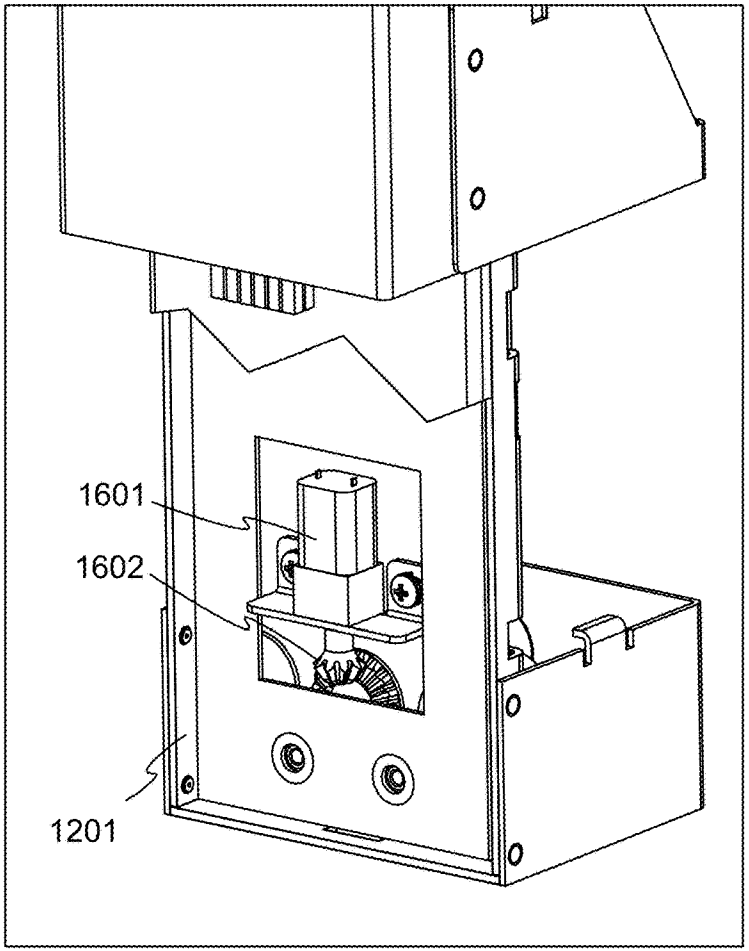
FIG. 16 illustrates a partially-cutaway rear view of the lower portion of a dispenser portion of the dispensing mechanism of FIGS. 12A and 12B.

FIG. 16 illustrates a partially-cutaway rear view of the lower portion of dispenser 1201. As is visible in FIG. 16, a motor 1601 turns a shaft through right-angle gears 1602. Motor 1601 may be, for example, a stepper motor or a simple DC or AC motor, operated in the manner described above in relation to dispensing mechanism 202. That is, motor 1601 may be incrementally advanced either by control of the steps of a stepper motor, or by running motor 1601 only until the dispensing of an item is detected.

In other embodiments, an actuator other than a motor may be used. For example, a solenoid or memory metal actuator may provide a reciprocating motion that is used to drive the gear within dispenser 1201 using a ratchet or ratchet-like arrangement. Other kinds of actuators and driving arrangements are possible.

Figure 17:
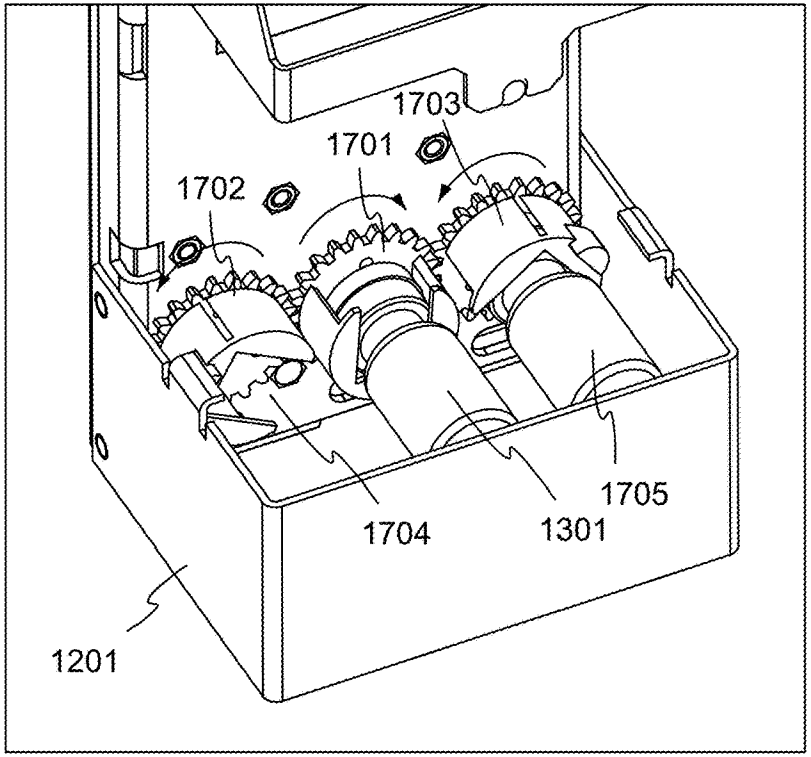
FIG. 17 illustrates a front view of the lower portion of the dispenser of FIG. 16, showing additional details of its operation.

FIG. 17 illustrates a front view of the lower portion of dispenser 1201, showing additional details of its operation. A central slotted gear 1701 is driven directly by right angle gears 1602. While a rotation direction is shown for ease of explanation, the choice of rotation direction is arbitrary, and either direction may be used. slotted gear 1701 drives slotted gears 1702 and 1703. Each of the slotted gears has a T-shaped blind slot 1704 of a shape and size to receive the cylindrical top of a vial 1301. Here, "blind" means that the slot does not continue all the way through the slotted gear.

As the slotted gears rotate, the respective slots 1704 "take turns" reaching an upward vertical orientation and a downward vertical orientation. For example, the three slotted gears of example dispenser 1201 are meshed in such a way that one of the T-shaped slots reaches the upward vertical orientation for every 120 degrees of rotation of central slotted gear 1701. If different numbers of slotted gears are present, then a different angular separation of the gear positions may be used, but preferably slots 1704 reach the downward vertical orientation at evenly spaced angular intervals of the driving gear 1701.

When one of the slots reaches its upward vertical orientation and at least one vial is present in the corresponding T-shaped vertical channel of cassette 1202 (not shown), the vial is free to drop into the T-shaped blind slot 1704 of the respective slotted gear. In FIG. 17, slotted gear 1701 has just received a vial 1301 in this manner. Slotted gear 1703 has previously received a vial 1705. As the gears continue to turn, the slot in slotted gear 1702 approaches its downward vertical orientation. When the downward vertical orientation is reached, vial 1705 will be free to drop through opening 1206 into dispense drawer 107. Slot 1704 of slotted gear 1703 is approaching its upward vertical orientation, to receive another vial, if one is present. Thus, the vials in cassette 1202 can be dispensed one by one.

In some embodiments, dispensing mechanism 204 may include one or more sensors for directly detecting movement of a mechanical component of dispensing mechanism 204. For example, the driven gear within dispenser 1201 may have holes around its main portion, so that the remaining material between the holes functions as broad spokes. A reflective optical sensor may be provided within dispenser 1201 that shines light (for example infrared light) onto the driving gear and can detect whether a return reflection is received. Rotation of the gear then results in an alternating signal from the sensor as the reflective "spokes" and the non-reflective holes alternately pass the sensor. A processor or other circuitry within dispenser 1201 can interpret this signal to verify the motion of the driven gear. This direct measurement provides additional feedback as to the operation of dispensing mechanism 204. For example, if it is verified using the additional sensor that the gear has moved sufficiently far that an item should be dispensed (120 degrees in the example embodiment), but the light curtain sensor does not detect the dispensing of an item, it may be determined that cassette 1202 is empty, or it may be suspected that an error has occurred.

Other kinds of sensors could be used to directly measure mechanical motion. For example, the teeth of slotted gear 1702 or 1703 may be visible to a reflective optical sensor shining light through an opening the wall of dispenser 1201, and the rotation of the slotted gears may be detected by monitoring the passing of the individual gear teeth. Preferably, any active parts of the sensing system reside in dispenser 1201, so that cassette 1202 does not include active electrical components.

Dispenser for Syringes and Other Similarly-Shaped Items

Figure 18B:
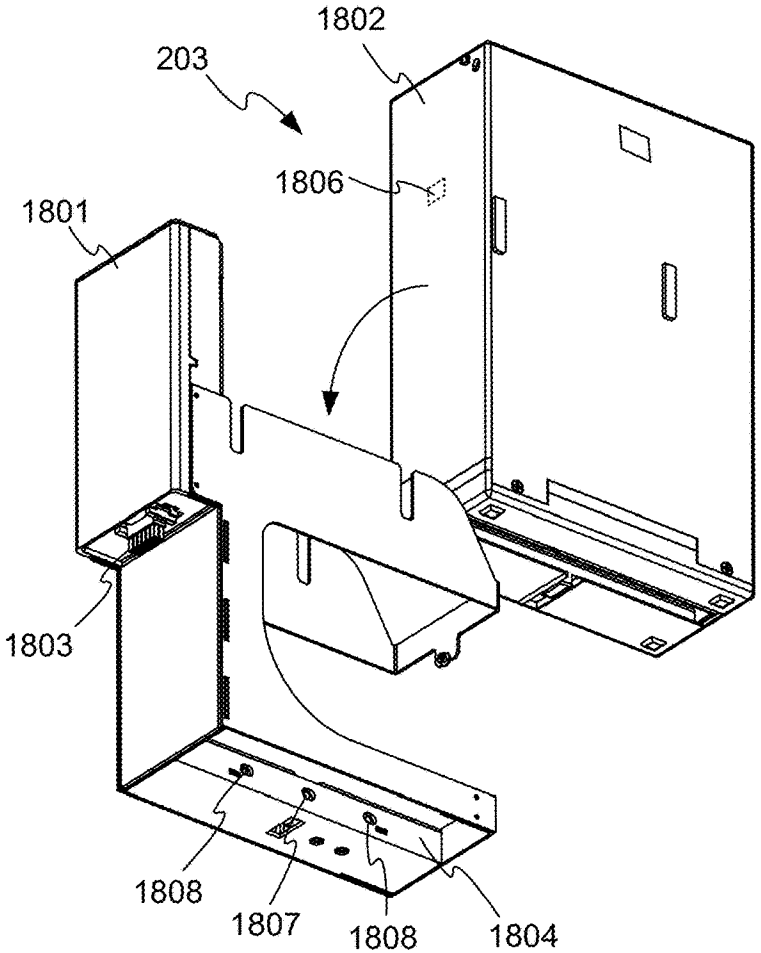
FIGS. 18A and 18B illustrate upper and lower views of a third dispensing mechanism in accordance with embodiments of the invention.
Figure 18A:
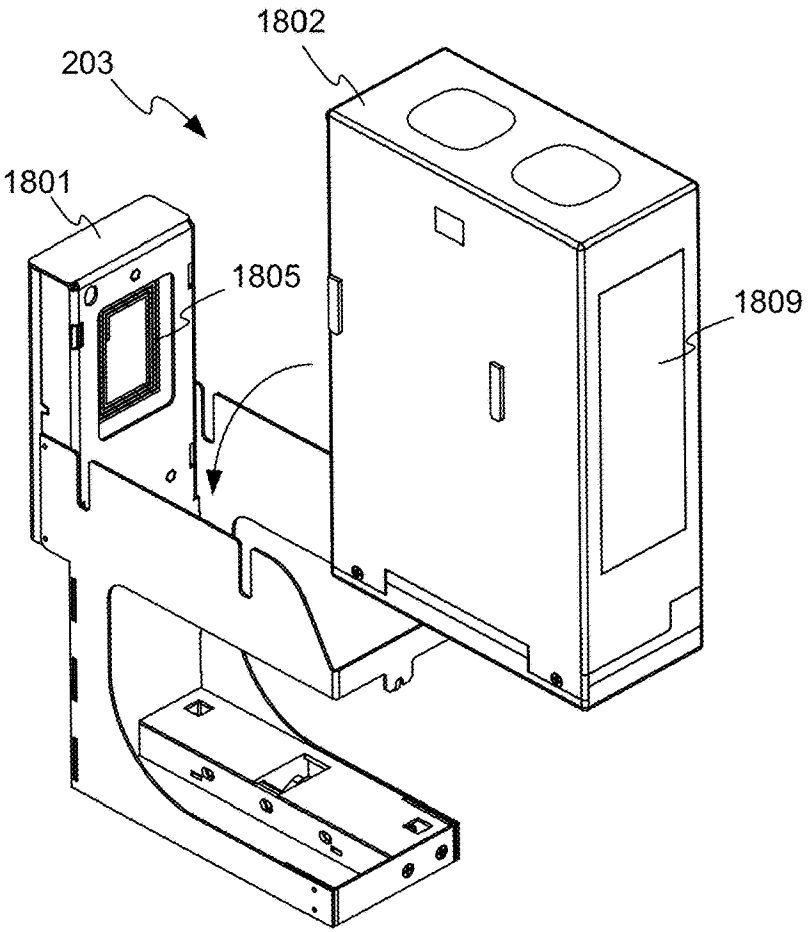

FIGS. 18A and 18B illustrate upper and lower views of dispensing mechanism 203 in more detail. Dispensing mechanism 203 may be especially useful for dispensing cylindrical items such as syringes, although dispensing mechanism 203 may be useful for dispensing may other similarly-shaped items as well.

Example dispensing mechanism 203 comprises a dispenser 1801 and a cassette 1802, which are separable. For example, dispenser 1801 and cassette 1802 may snap together, may be separable with the removal of one or a small number of screws, or may be reasonably separable in some other way without damage to either dispenser 1801 or cassette 1802. In this way, restocking may be accomplished by replacing a depleted cassette 1802 with a full cassette 1802.

As is visible in FIG. 18B, a connector 1803, compatible with connectors 302 on rails 201, is positioned to engage one of connectors 302 when dispensing mechanism 203 is installed in restock drawer 106. Dispenser 1801 defines an opening 1804 at the bottom of dispensing mechanism 203, through which items are dispensed. Dispensing mechanism 203 may be removably secured to one of rails 201 using a snap mechanism, one or more screws, or by another method.

Preferably, cassette 1802 does not contain any active electrical components. All of the active components of dispensing mechanism 203 reside in dispenser 1801. For example, an antenna 1805 can excite a passive memory chip 1806 in cassette 1802, to determine the contents of cassette 1802 (written into passive memory chip 1806 when cassette 1802 was filled at a remote location). If desired, antenna 1805 can also be used to update the data in passive memory chip 1806. This wireless data exchange may use any suitable wireless protocol, for example Near Field Communications (NFC), radio frequency identification (RFID), or another wireless protocol.

Dispenser 1801 can preferably automatically detect the installation and removal of cassette 1802. This automatic detection may facilitate the inventory and tracking of items, and also can help prevent illicit diversion of items. The detection may be accomplished in any suitable way, for example periodic polling using antenna 1805, a contact sensor (not shown) that can detect the presence of cassette 1802 electromechanically, or by another technique.

A light emitter 1807 and two light receivers 1808 are positioned near the bottom of dispenser 1801. In operation, light from light emitter 1807 reflects from a reflective surface of dispenser 1801 (not visible in FIGS. 18A and 18B, but opposite light emitter 1807 and receivers 1808) and returns to light receivers 1808, so long as it is not interrupted by an item being dispensed and falling through the "light curtain" formed across opening. When an item is dispensed through opening 1804, it interrupts the light received by either or both of light receivers 1808, and dispenser 1801 can note that an item has in fact been dispensed. If no light interruption is detected despite a command to dispense an item, computer 103 may assume that a misfeed or other problem has occurred, or that cassette 1802 is empty. By using more sophisticated monitoring strategies, accidental dispensing of multiple items may be detected. For example, if two interruptions of the light curtain are detected closely spaced in time, a double feed may be indicated. Emitter 1807 may be of any suitable type of emitter, and may emit light in any suitable wavelength or combinations of wavelengths. For example, light emitter 1807 may be a light emitting diode, a laser such as a vertical cavity semiconductor emitting laser (VCSEL) or another kind of light source, and may emit visible light, infrared light, or light in other suitable wavelength bands or combinations of wavelength bands.

A clear window 1809 may be provided, so that a user can see the contents of cassette 1802.

Although not shown in FIGS. 18A and 18B, a button and light similar to button 601 and light 602 discussed above, for communication between a restocking technician or other user and computer 103 of cabinet 100.

Figure 19:
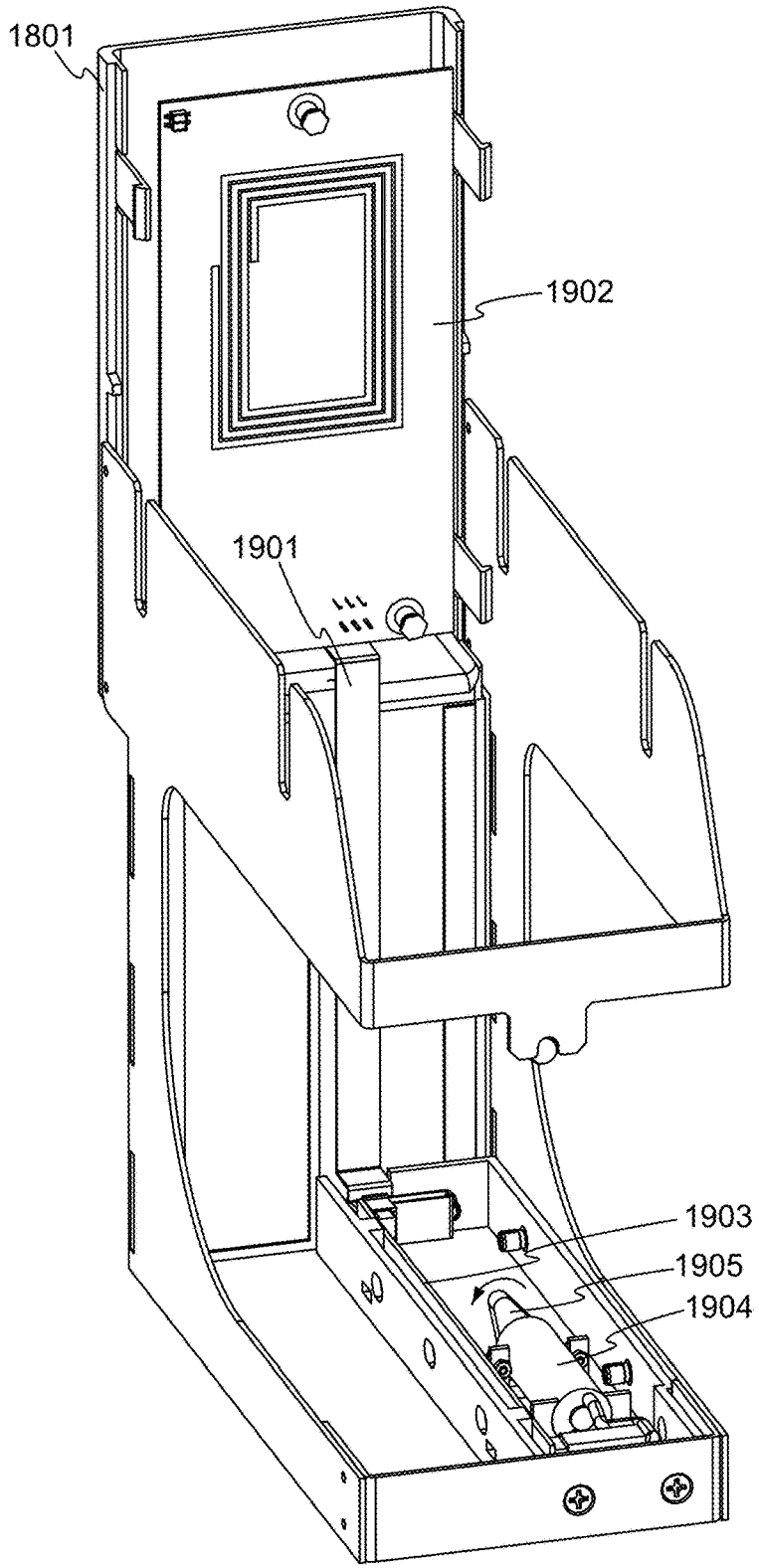
FIG. 19 shows an oblique view of a dispenser portion of the dispensing mechanism of FIGS. 18A and 18B with some parts removed, revealing internal details of the operation of the dispenser portion.

FIG. 19 shows an oblique view of dispenser 1801 with some parts removed, revealing internal details of the operation of dispenser 1801. A cable 1901 connects a first circuit board 1902 with a second circuit board 1903, to which a motor 1904 is connected. Motor 1904 may be, for example, a stepper motor whose angular position can be readily moved incrementally and held. In that case, an item may be dispensed by advancing motor 1904 by one rotation. If the light curtain does not detect that an item is dispensed, motor 1904 may be advanced further, and if no dispensing is yet detected, and error message may be generated, or it may be assumed that cassette 1802 is empty. Alternatively, motor 1904 may be a simple DC or AC motor, in which case dispensing may be accomplished by simply running motor 1904 until the dispensing of an item is detected, and then shutting off the motor. A time limit may be imposed, such that if no dispensing is detected within the time limit with motor 1904 running, the motor may be shut off and an error message generated.

Motor 1904 turns a cam 1905 in the direction shown, the function of which is explained in more detail below.

A microprocessor, microcontroller, or similar controlling circuitry may reside within dispenser 1801, and may operate the various active components and sensors of dispenser 1801 in response to high-level commands from a supervisory controller elsewhere within restock drawer 106, or from computer 103. In that case, dispenser 1801 is considered a "smart" dispenser, because it includes some processing intelligence. However, other architectures are possible. For example, logic signals from a supervisory controller elsewhere within restock drawer 106 may operate dispenser 1801.

Figure 20:
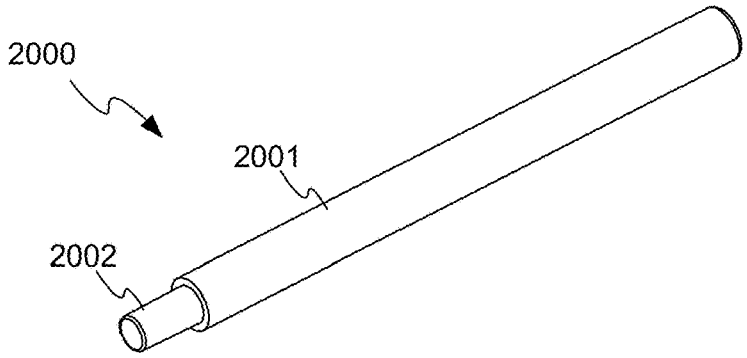
FIG. 20 illustrates a syringe as may be dispensed by the dispensing mechanism of FIGS. 18A and 18B.

As was discussed above, dispensing mechanism 203 may be especially useful for dispensing syringes or other similarly-shaped items. FIG. 20 illustrates a typical syringe 2000 of a kind that may be dispensed by dispensing mechanism 203. Syringe 2000 has a main barrel 2001 configured to hold a quantity of a serum or other liquid, and a reduced diameter portion 2002 configured to accept a hypodermic needle or the like. In some embodiments, the outer diameter of main barrel portion may be about 11.2 mm, and the overall length of syringe 2000 may be in keeping with the capacity of syringe 2000. For example, a syringe 2000 configured to hold 1 ml of liquid may have an overall length of about 115 mm, while a syringe 2000 configured to hold 2 ml of liquid may have an overall length of about 148 mm. These dimensions are given only as examples, and syringes or other items having different sizes may be used in embodiments of the invention.

Figure 21A:
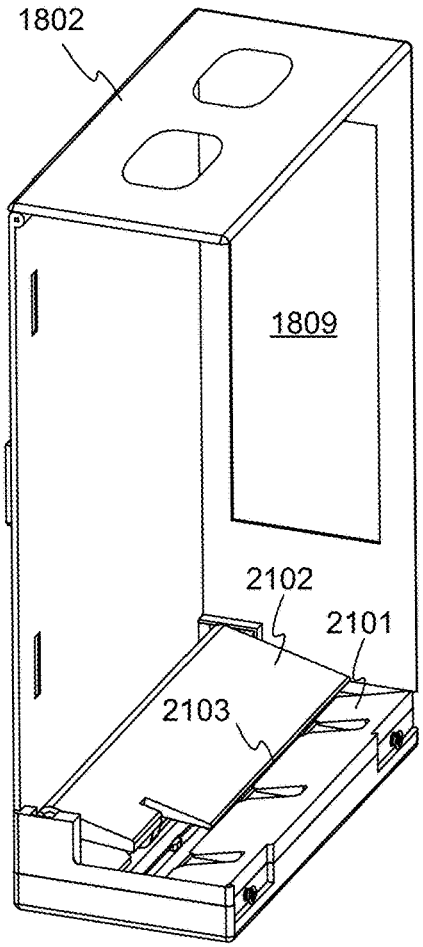
FIGS. 21A and 21B illustrate a cassette portion of the dispensing mechanism of FIGS. 18A and 18B with certain outer panels removed, and revealing internal details of the cassette portion.
Figure 21B:
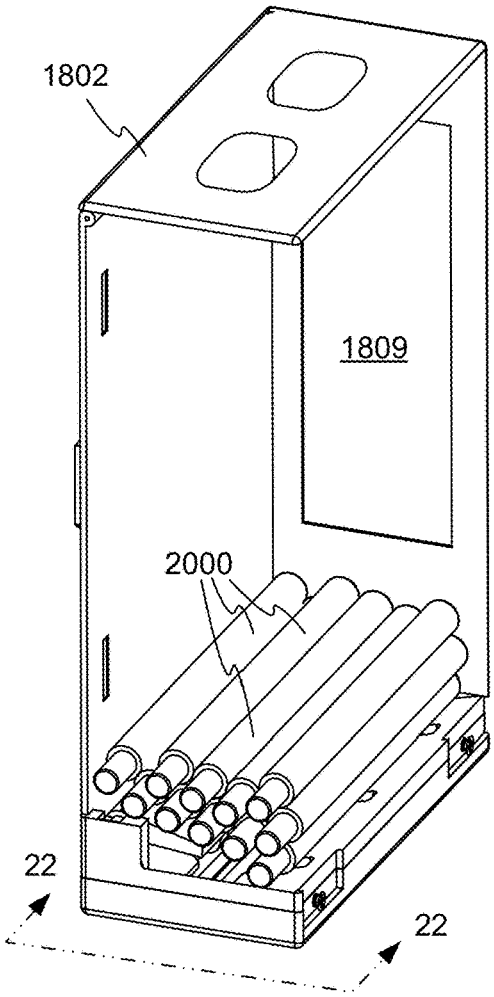

FIGS. 21A and 21B illustrate cassette 1802 with certain outer panels removed, and revealing internal details of cassette 1802. In FIG. 21A, cassette 1802 is empty, and in FIG. 21B, cassette 1802 contains a number of syringes 2000. An angled floor 2101 of cassette 1802 and an angled moveable guide 2102 serve to funnel syringes 2000 toward the lowest part 2013 of cassette 1802, to be dispensed in the manner described below. While other dimensions are possible, example cassette 1802 is about 234 mm high, 71 mm deep, and 153 mm wide, and thus displaces an overall volume of less than 2600 cubic centimeters, and can hold up to 120 or more syringes 2000. Cassette 1802 thus displaces less than 22 cubic centimeters for each syringe that can be stored in cassette 1802. While syringes 2000 having a 2 ml capacity are shown, cassette 1802 may be configured to dispense syringes having a smaller overall length by placing a spacer block (not shown) within cassette 1802. In various embodiments, cassette 1802 may displace less than 25, less than 20, less than 15, or less than 10 cubic centimeters for each item stored in cassette 1802 at full capacity.

Figure 22A:
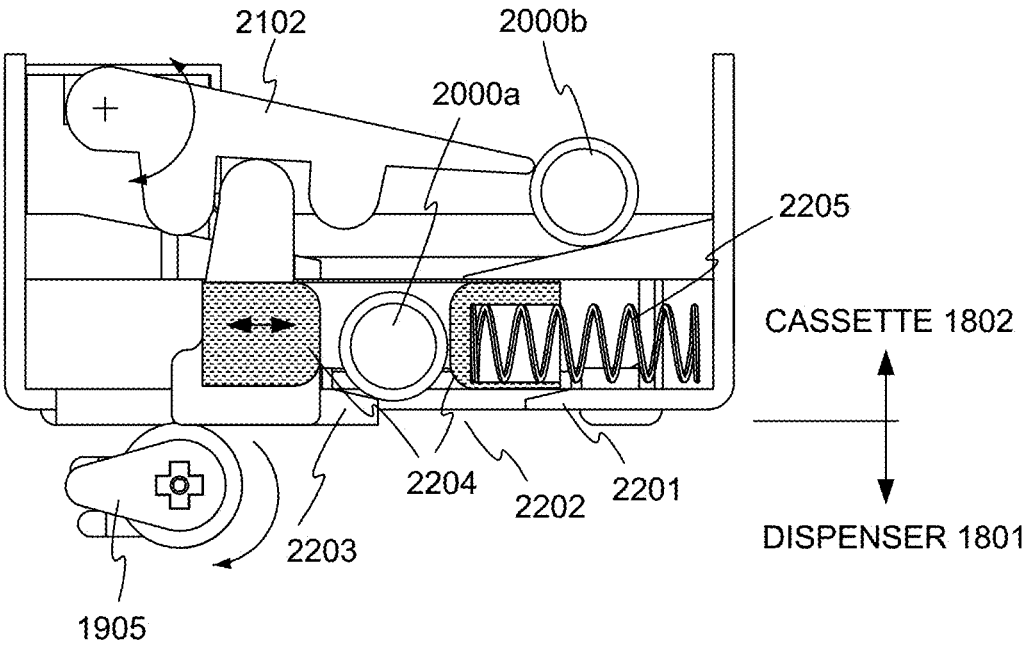
FIGS. 22A-22C illustrate a cutaway view of portions of the dispensing mechanism of FIGS. 18A and 18B and their operation to dispense a syringe.
Figure 22B:
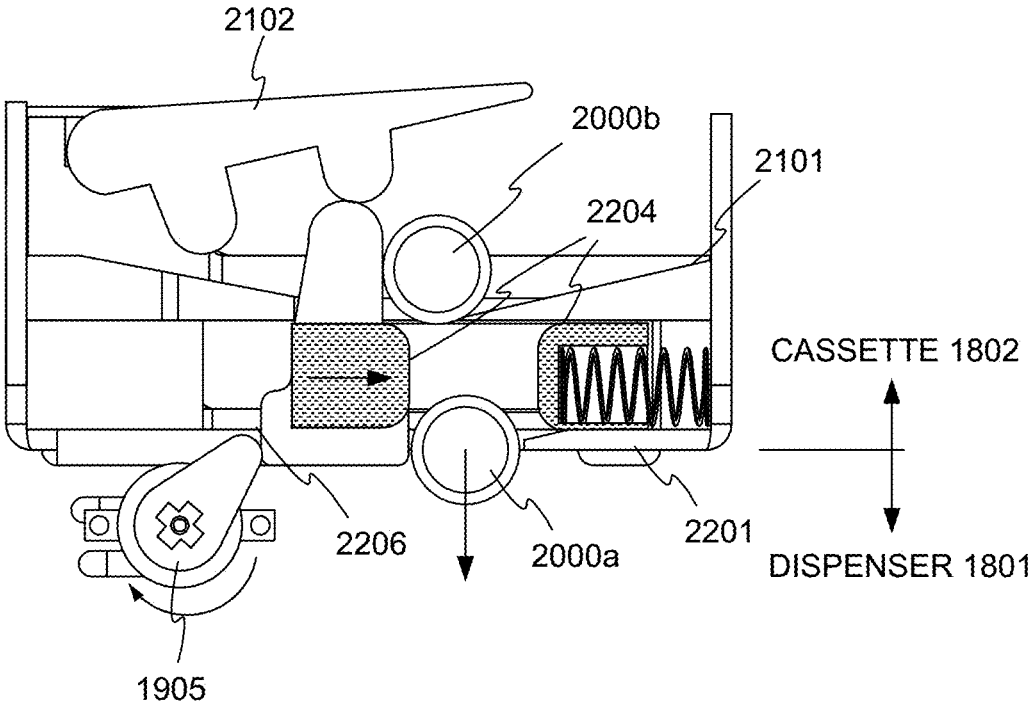
Figure 22C:
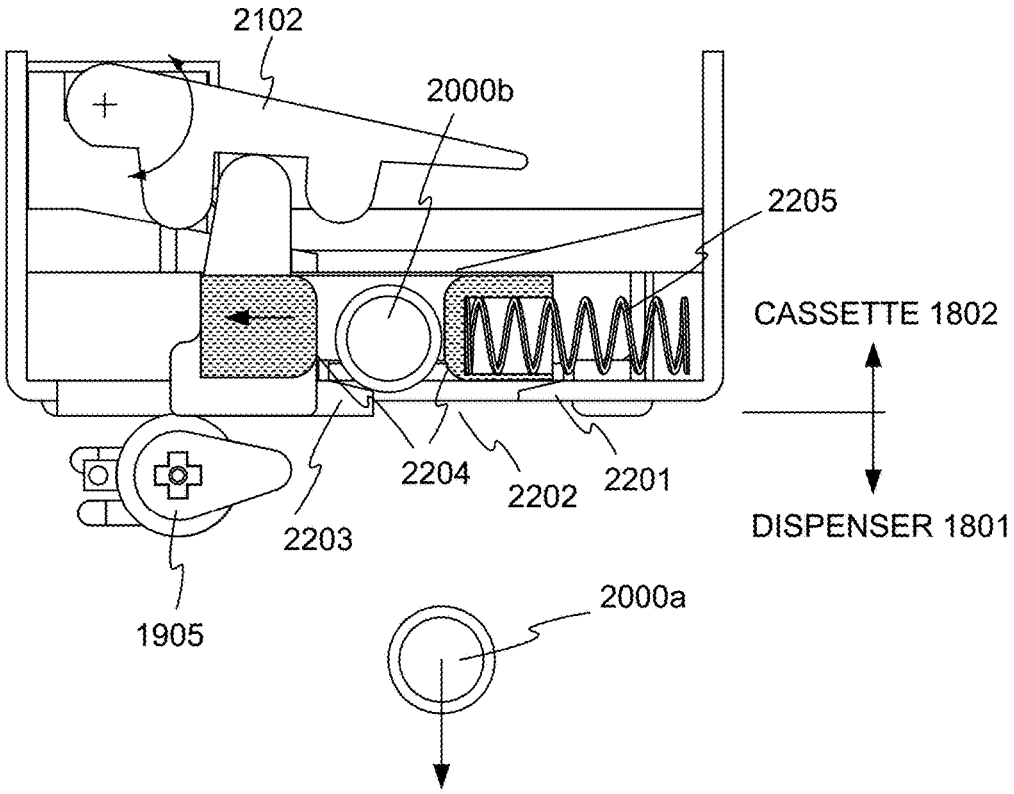

FIGS. 22A-22C illustrate a cutaway view of portions of dispenser 1801 and cassette 1802 and their operation to dispense a syringe. A bottom tray 2201 of cassette 1802 defines an opening 2202 and a ledge 2203. A movable slide 2204 defines a slot in which syringe 2000*a* is positioned in FIG. 22A. Slide 2204 is biased to the left by spring 2205, such that syringe 2000*a* remains suspended by ledge 2203. Syringe 2000*a* is in position to be dispensed, while cassette 1802 contains additional syringes such as syringe 2000*b*. Spring 2205 also ensures that the syringes in cassette 1802 are not accidentally dispensed when cassette 1802 is separated from dispenser 1801, for example during transport from a central pharmacy to cabinet 100.

When it is desired to dispense a syringe, motor 1904 (not visible in FIGS. 22A-22C) turns cam 1905 as shown in FIG. 22B. Cam 1905 acts against surface 2206 of slide 2204, moving slide 2204 to the right, aligning the slot in slide 2204 with opening 2202 in bottom tray 2201 of cassette 1802. Syringe 2000*a* can accordingly drop through opening 2202 and into dispense drawer 107. Syringe 2000*b* rolls down angled floor 2010 into position between slide 2204 and angled floor 2101. Guide 2102 is force upward by its interaction with slide 2204, to jostle any remaining syringes within cassette 1802, facilitating their future dispensing.

In FIG. 22C, cam 1905 has rotated past its contact with slide 2204, allowing spring 2205 to force slide 2204 back to its nominal position. Sensor electronics may sense the dispensing of syringe 2000*a*, or that slide 2204 is back to its nominal position, and may shut off motor 1904, stopping cam 1905. Syringe 2000*b* drops into the slot in slide 2204, resting on ledge 2203, in preparation for its future dispensing.

In other embodiments, an actuator other than a motor may be used. For example, a solenoid or memory metal actuator may provide a translational motion that is used to directly translate slide 2204 against spring 2205. Other kinds of actuators and driving arrangements are possible.

In some embodiments, dispensing mechanism 203 may include one or more sensors for directly detecting movement of a mechanical component of dispensing mechanism 203. For example, slide 2204 may be generally non-reflective, but may include a reflective sticker placed for detection by a reflective optical when slide 2204 moves under the action of cam 1905. The passing of the reflective sticker, as detected by the sensor, verifies that slide 2204 has actually moved. A similar effect may be achieved by placing a magnet on slide 2204 and detecting its passing of a Hall Effect sensor. Similarly, the movement of cam 1905 could be directly sensed. A processor or other circuitry within dispenser 1801 can interpret a signal produced by the sensor to verify the motion of the slide or cam. This direct measurement provides additional feedback as to the operation of dispensing mechanism 203. For example, if it is verified using the additional sensor that slide 2204 has moved sufficiently far that an item should be dispensed, but the light curtain sensor does not detect the dispensing of an item, it may be determined that cassette 1802 is empty, or it may be suspected that an error has occurred.

Other kinds of sensors could be used to directly measure mechanical motion. For example, the passing of paddles 1004 may be detected by a reflective optical sensor shining light through an opening the wall of chamber 1005. Preferably, any active parts of the sensing system reside in dispenser 701, so that cassette 702 does not include active electrical components.

Figure 23:
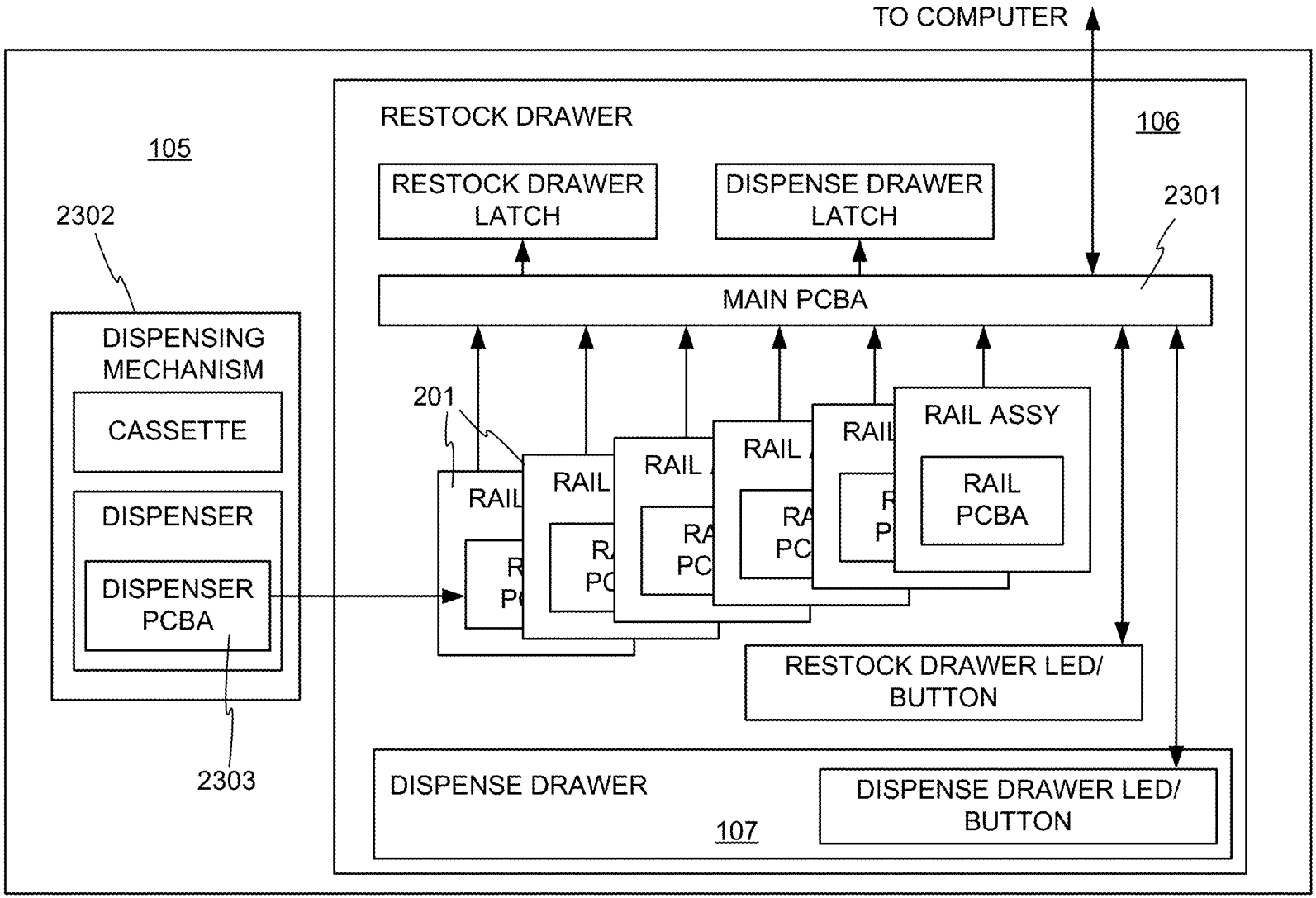
FIG. 23 illustrates an electrical block diagram of the dispensing unit of FIG. 2, in accordance with embodiments of the invention.

FIG. 23 illustrates an electrical block diagram of dispensing unit 105, in accordance with embodiments of the invention. Among other components, dispensing unit 105 includes a main PCBA 2301, and a number of rail assemblies 201, each of which includes a respective PCBA. Only one generic dispensing mechanism 2302 is shown, but it will be recognized that a number of dispensing mechanisms such as dispensing mechanisms 202, 203, and 204 may be present. Each dispensing mechanism may have its own PCBA 2303.

Figure 24:
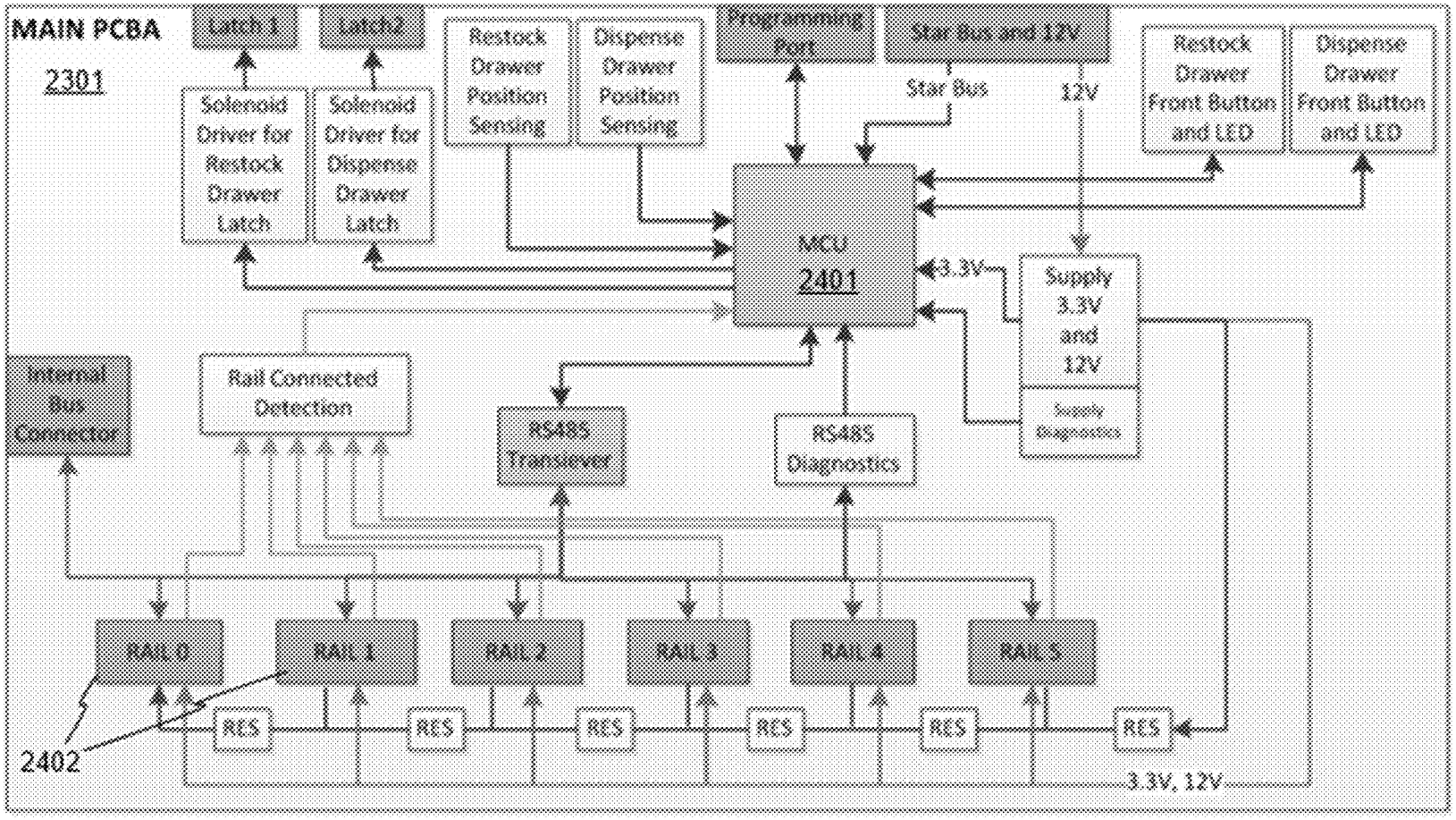
FIG. 24 illustrates an electrical block diagram of a printed circuit board in the restock drawer of FIG. 2, in accordance with embodiments of the invention.

FIG. 24 illustrates a more detailed electrical block diagram of restock drawer 106 main PCBA 2301, in accordance with embodiments of the invention. Main PCBA 2301 include a microcontroller 2401, as well as various sensing and communication circuitry, and connections 2402 for connection to rail assemblies 201.

Figure 25:
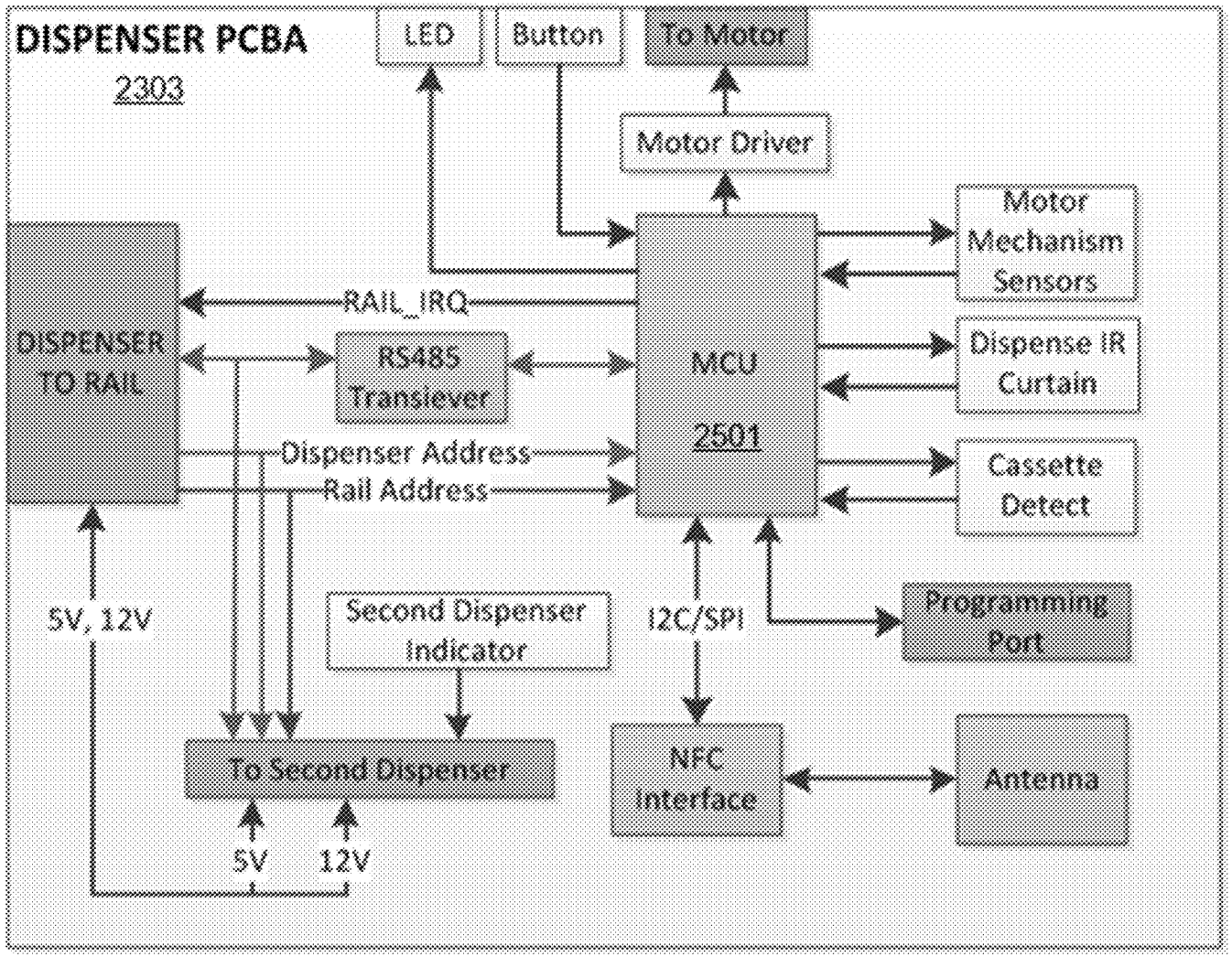
FIG. 25 illustrates an electrical block diagram of a dispenser as may be used in the dispensing mechanisms of FIGS. 6A, 12A, and 18A, in accordance with embodiments of the invention.

FIG. 25 illustrates a more detailed electrical block diagram of a dispenser PCBA 2303, in accordance with embodiments of the invention. In this example, the dispenser includes a microcontroller 2501, and the dispenser represented is a "smart" dispenser. Dispenser PCBA 2303 also includes various power and communication circuitry, driver circuitry for a motor, a wireless communication interface and antenna, various other sensors, and other components, many of which may be described above in relation to dispensers 701, 1201, and 1801.

In the claims appended hereto, the term "a" or "an" is intended to mean "one or more." The term "comprise" and variations thereof such as "comprises" and "comprising," when preceding the recitation of a step or an element, are intended to mean that the addition of further steps or elements is optional and not excluded. It is to be understood that any workable combination of the elements and features disclosed herein is also considered to be disclosed.

The invention has now been described in detail for the purposes of clarity and understanding. However, those skilled in the art will appreciate that certain changes and modifications may be practiced within the scope of the appended claims.

What is claimed is:

1. A dispensing mechanism, comprising:

a set of T-shaped vertical channels of a shape and size to receive cylindrical tops of a number of vials and hold the vials in vertical stacks;

a connector for receiving electrical signals from a cabinet in which the dispensing mechanism is removably installed;

an actuator that moves in response to the electrical signals;

a plurality of gears driven by the actuator, each of the gears being coupled to a receiver positioned under a respective one of the T-shaped vertical channels and each receiver being of a shape and size to receive one of the vials; and a housing defining an opening at the bottom of the dispensing mechanism;

wherein when the gears are driven, their respective receivers sequentially align with the T-shaped vertical channels, such that upon alignment, one of the vials drops into the respective receiver capturing the respective vial, and when one of the receivers holding a vial approaches a downward vertical orientation, a single vial drops from the downwardly-oriented receiver and through the opening.

2. The dispensing mechanism of claim 1, wherein each of the receivers comprises a T-shaped blind slot of a shape and size to receive the cylindrical top of one of the vials.

3. The dispensing mechanism of claim 1, wherein the connector carries electrical power to the dispensing mechanism, and carries bi-directional communication signals between the dispensing mechanism and a controller of the cabinet.

4. The dispensing mechanism of claim 1, comprising at least three gears, one of the gears driving the others, the gears meshed such that their receivers reach the downward vertical orientation at evenly spaced angular intervals of the driving gear.

5. The dispensing mechanism of claim 1, further comprising:

a light emitter directed across the opening; and one or more receivers that detect light from the light emitter reflected from a far wall of the opening, the light emitter and the one or more receivers positioned such that the light detected by at least one of the one or more receivers is interrupted by the passage of a vial dispensed through the opening.

6. The dispensing mechanism of claim 1, wherein the dispensing mechanism is configured to dispense vials having a diameter of about 22 millimeters, and is configured to dispense vials having a diameter of about 15 millimeters.

7. The dispensing mechanism of claim 1, wherein the actuator comprises a motor, a solenoid, or a memory metal.

8. The dispensing mechanism of claim 7, wherein the actuator is a motor, and wherein the dispensing mechanism further comprises a set of right-angle gears through which the motor drives the gears that are coupled to the receivers.

9. The dispensing mechanism of claim 7, wherein the actuator is a stepper motor.

10. The dispensing mechanism of claim 1, wherein:

the T-shaped vertical channels are comprised in a cassette, and the connector, actuator, and gears are comprised in a dispenser;

the cassette and dispenser are separable; and the cassette does not include any active electrical components.

11. The dispensing mechanism of claim 10, wherein the dispenser is configured to automatically detect the installation and removal of the cassette on the dispenser.

12. The dispensing mechanism of claim 10, wherein:

the cassette includes a wirelessly-readable memory; and the dispenser includes a reader for reading the wirelessly-readable memory.

13. The dispensing mechanism of claim 12, wherein the wirelessly-readable memory is also writeable wirelessly.

14. The dispensing mechanism of claim 12, wherein the wirelessly-readable memory is readable via a near field communication (NFC) or radio frequency identification (RFID) protocol.

15. The dispensing mechanism of claim 12, wherein the reader comprises an antenna, and wherein the dispenser is configured to automatically detect the installation and removal of the cassette on the dispenser using the antenna.

16. The dispensing mechanism of claim 10, wherein the cassette further comprises a latch that retains vials within the cassette when the cassette is separated from the dispenser, and that permits the vials to reach the receivers when the cassette is assembled to the dispenser.

17. The dispensing mechanism of claim 10, wherein the cassette displaces less than 30 cubic centimeters for each vial stored in the cassette at full capacity.

18. The dispensing mechanism of claim 1, further comprising a sensor that directly measures motion of a mechanical component of the dispensing mechanism.

19. The dispensing mechanism of claim 18, wherein at least one of the gears includes spokes that are reflective of infrared light, and wherein the sensor detects light reflected from the spokes.

20. The dispensing mechanism of claim 18, wherein the sensor detects light reflected from the teeth of one of the gears.

* * * * *